252-99 AU 165 EX
1/25/77 XR 4,005,025

United States Patent [19]
Kinstedt

[11] 4,005,025
[45] Jan. 25, 1977

[54] ORGANOSILANE-CONTAINING ANIONIC DETERGENT COMPOSITION

[75] Inventor: George Carl Kinstedt, Fairfield, Ohio

[73] Assignee: The Procter & Gamble Company, Cincinnati, Ohio

[22] Filed: May 5, 1975

[21] Appl. No.: 574,817

[52] U.S. Cl. ..... 252/89 R; 252/186; 252/99; 252/547; 260/448.2 N; 260/448.8 R; 252/DIG. 15; 427/212; 427/221

[51] Int. Cl.² ..... C11D 3/16; C11D 3/36

[58] Field of Search ..... 252/89, 186, 547; 260/448.2 N, 448.8 R; 427/212, 219, 220, 221

[56] References Cited

UNITED STATES PATENTS 3,624,120 11/1971 Yetter ..... 260/448.2 N

*Primary Examiner*—Mayer Weinblatt
*Attorney, Agent, or Firm*—C. R. Wilson; R. B. Aylor; T. H. O'Flaherty

[57] ABSTRACT

The performance of an aqueous detergent composition containing an anionic detergent and an organosilane capable of imparting soil release benefits to hard surfaces washed therewith is enhanced by the addition of free alkalinity and/or mineral hardness ions. The detergent composition can be formulated for use in a wide range of applications such as dishwashing liquids, car wash compositions and general hard surface cleaners.

31 Claims, No Drawings

ORGANOSILANE-CONTAINING ANIONIC DETERGENT COMPOSITION

BACKGROUND OF THE INVENTION

This invention relates to a detergent composition containing an anionic detergent and an organosilane compound. The detergent compositions of this invention are intended for use on hard, i.e., metallic and vitreous surfaces. More particularly, the inclusion of the hereindescribed organosilane compound in detergent compositions provides soil release benefits to surfaces washed with such compositions.

Detergent compositions intended for use on hard surfaces are continually being reformulated in order to improve their performance. Generally, detergent compositions are formulated to obtain optimum cleaning performance. Such endeavors have revolved around the use of different organic detergents as well as the use of detergent builders and various additives, e.g., enzymes, bleaches and pH modifiers. Considerations such as human safety, compatibility of components, and equipment safety have played a part in dictating what components are available for improving existing detergent compositions.

Other attempts at insuring that hard surfaces are clean have involved the application of various surface coatings to such hard surfaces. For example, cookware which has been coated with Teflon provides a surface which is easier to clean. Thus, while soil continues to deposit upon the surface, its removal is easier by virtue of the coating. Unfortunately, such coatings are relatively expensive. Moreover, such a coating on glassware would be objectionable due to its appearance and/or feel. Since this kind of a coating must be applied by the manufacturer of the cookware or glassware, it must be permanent. This generally involves a relatively heavy coating with the consequent drawback in terms of cost, appearance, and/or feel.

It has recently been discovered that a very thin layer of a compound possessing soil release benefits can be supplied to metallic and vitreous surfaces by a detergent composition. Thus, when the detergent composition is used for cleaning or washing a hard surface, a thin semi-permanent coating of a compound is laid down. The amount of coating is sufficient to provide a soil release benefit to the surface, while at the same time, is not visible or expensive.

Commonly assigned copending patent application, U.S. Ser. No. 570,533, "Organosilane-Containing Anionic Detergent Composition", Heckert and Watt, filed Apr. 22, 1975, discloses the addition of certain positively charged organo silanes to a detergent composition containing an anionic surfactant as the active detergent. It has now been found that improvements in the stability and efficacy of such organosilane-anionic surfactant combinations can be made by adjusting the alkalinity and/or mineral hardness ion level of the formulations. Furthermore it has been found that, by increasing the alkalinity and/or mineral hardness level of anionic surfactant-containing compositions, a wider range of organosilanes can be incorporated than was hitherto thought possible.

It accordingly is an object of this invention to provide aqueous detergent compositions containing organosilanes that are capable of imparting a soil release benefit to surfaces contacted therewith.

It is another object of this invention to provide detergent compositions containing anionic detergents and organosilanes that are able to provide soil release benefits to metallic and vitreous surfaces when applied thereto from a wash or rinse solution.

As used herein, all percentages and ratios are by weight unless otherwise indicated.

SUMMARY OF THE INVENTION

According to the invention there is provided a detergent composition capable of imparting soil release benefits to metallic and vitreous surfaces contacted therewith consisting essentially of:

a. an organosilane having the formula $$(R_1O)_{3-a}-\overset{(R_2)_a}{\overset{|}{Si}}-(CHR_3)_b-[O-CH_2-CHOH-CH_2]_c-\overset{R_4}{\overset{|}{\underset{R_4}{\underset{|}{Y^+}}}}-R_5\ X^-$$

or a siloxane oligomer thereof wherein $R_1$ is an alkyl group containing 1 to 4 carbon atoms or $$Z(OC_xH_{2x})_m$$

where $x$ is 2 to 4, $m$ is 1 to 20, and Z is hydrogen, an alkyl group containing 1 to 3 carbons, or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or aryl alkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen; $R_5$ is an alkyl, aryl or arylalkyl group containing 1 to 18 carbon atoms; X is halide; and Y is nitrogen, sulfur, or phosphorus and the sum of the carbon atoms in $R_2$, $R_3$, $R_5$ and $R_4$ when $R_4$ is alkyl, aryl, arylalkyl or carboxy-substituted alkyl does not exceed 30 carbon atoms;

b. a water-soluble organic anionic detergent in a weight ratio of organosilane to detergent of from 1:1 to 1:10,000; and c. a source of alkalinity in an amount such that a 0.2% aqueous solution of the composition has a pH in the range 8.5–10.5, said source being selected from the group consisting of inorganic and organic bases.

DESCRIPTION OF THE INVENTION

The subject invention relates to all manner of detergent compositions. As examples, may be mentioned the following: light duty liquid detergent compositions, car wash detergent compositions, window cleaners, oven cleaners and toilet bowl cleaners. The previous listing is merely illustrative and is in no way limiting. Such compositions are further described hereinafter. The compositions may be used on any metallic or vitreous surface where a soil release benefit is desired. Examples of such surfaces are cooking utensils (e.g. metallic pots, pans and skillets), tableware (e.g. china, glasses, ceramic ware and flatware), oven walls, windows, and porcelain surfaces (e.g. bathtubs, sinks, and toilet bowls).

The detergent compositions of this invention contain three essential components, namely an organosilane, a water-soluble anionic detergent and a source of free alkalinity. The ratio of organosilane to anionic detergent lies in the range of from 1:1 to 1:10,000, preferably 1:1 to 1:500, most preferably 1:3 to 1:60. The first component, namely, the organosilane, has the following formula:

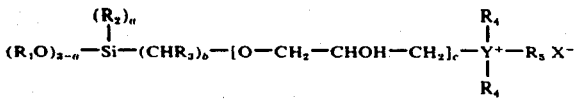

or is a siloxane oligomer thereof wherein $R_1$ is an alkyl group containing 1 to 4 carbon atoms or $$Z(OC_xH_{2x})_m$$

where $x$ is 2 to 4, $m$ is 1 to 20, and Z is hydrogen, an alkyl group containing 1 to 3 carbon atoms or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen; $R_5$ is an alkyl, aryl or arylalkyl group containing 1 to 18 carbon atoms; X is halide; Y is nitrogen, sulfur or phosphorus and the sum of the carbon atoms in $R_2$, $R_3$, $R_5$, and $R_4$ when $R_4$ is alkyl, aryl, arylalkyl or carboxy-substituted alkyl does not exceed 30. Preferably X is chloride or bromide and $b$ is 1 and the sums of $R_2$, $R_3$, $R_5$ and $R_4$ when $R_4$ is alkyl, aryl, arylalkyl or carboxy-alkyl does not exceed 25.

It should be understood that the $R_4$ in the above formula and the formulae to follow may be the same or different. It should further be understood that when Y is S, there will be only one $R_4$ substituent. Also, when one $R_4$ is oxygen or, under basic conditions, the anion of a carboxylic acid substituted alkyl, the counter ion $X^-$ is not extant. The 1 to 4 carbon atoms in the carboxy-substituted alkyl group is inclusive of the carboxyl group. The aryl and arylalkyl groups of $R_4$ and $R_5$ contain 6 to 18 carbon atoms.

Classes of organosilane compounds and their preparation which fit the above description follow.

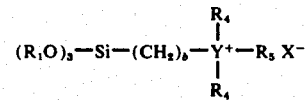

I.

wherein $R_1$ is a $C_{1-4}$ alkyl group, $b$ is from 1–3, $R_4$ is a $C_{1-18}$ alkyl, aryl or arylalkyl group, a carboxy-substituted $C_{1-4}$ alkyl group, $$(C_xH_{2x}O)_mZ$$

where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{4-18}$ alkyl, aryl or arylalkyl group, X is a halide, Y is N, S or P, and the sum of the carbon atoms in $R_5$ and $R_4$ when $R_4$ is alkyl, aryl, arylalkyl or carboxy-substituted alkyl does not exceed 30.

When $b$ is 3 and $R_4$ is a $C_{1-18}$ alkyl, aryl or arylalkyl group, the class of compounds represented by Formula I is prepared by the following route:

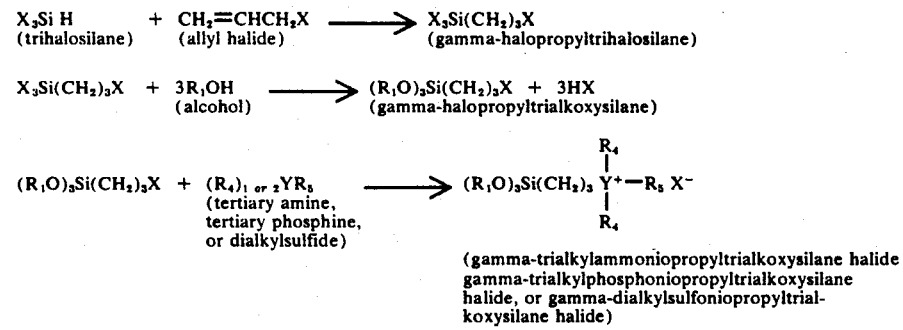

The trihalosilane (where the halogen is chlorine or bromine) is reacted with the allyl chloride at about 100° C. for from 4 to 10 hours in the presence of a catalyst, e.g., chloroplatinic acid or platinum. The resultant gamma-halopropyltrihalosilane is reacted with a lower alcohol to produce the gamma-halopropyltrialkoxysilane. At least three equivalents of alcohol per equivalent of halopropyltrihalosilane are added slowly to the silane. The gamma-halopropyltrihalosilane may be dissolved in an inert solvent, preferably hexane or pentane. (See W. Noll, "Chemistry and Technology of Silanes", Academic Press, New York, 1968, page 81 for the alcoholysis of halosilanes.) One equivalent of the gamma-halopropyltrialkoxysilane is reacted with one equivalent of the tertiary amine, tertiary phosphine, or dialkylsulfide to produce the organosilane. An inert solvent, preferably of high dielectric constant, may be used. The reaction is carried out at temperatures of from 40° to 120° C. and a time of 2 to 10 hours for the reaction of the bromopropyltrialkoxysilane and 120° to 150° C. for 2 to 20 hours for the reaction of the chloropropyltrialkoxysilane.

The compounds of Formula I when at least one $R_4$ is a carboxy-substituted $C_{1-4}$ alkyl group are prepared in the same manner except for the last reaction step. Here, a tertiary amine, tertiary phosphine or dialkylsulfide having a carboxy-containing alkyl group(s) is reacted with the alpha, beta or gamma-haloalkyltrialkoxysilane at 50° to 200° C. for 2 hours to 20 hours. Such carboxy-substituted tertiary amines, tertiary phosphines, and dialkylsulfides are produced by reacting $R_4YHR_5$ or $HYR_5$ (where Y is sulfur)

with $X(CH_2)_{1-4}COOH$ in the presence of base at elevated temperatures, e.g. 50° to 150° C.

The compounds of Formula I when at least one $R_4$ is $(C_xH_{2x}O)_mZ$ with $x$, $m$ and Z as defined above are produced in the manner given above except for the last reaction step. Thus, alphabeta- and gamma-haloalkyltrialkoxysilane is reacted with a tertiary amine, tertiary phosphine, or dialkylsulfide where at least one substituent is $(C_xH_{2x}O)_mZ$ The reaction takes place at a temperature of 50° to 200° C. and a time of from 2 to 10 hours.

Compounds of Formula I when one $R_4$ is oxygen are prepared by following the reactions outlined above up to the last reaction step. At this point, a dialkyl amine, dialkyl phosphine or alkylthiol is reacted with the halosilane at 50° to 200° C. for from 4 to 10 hours and then with base to produce an intermediate tertiary amine, phosphine, or dialkyl sulfide. These intermediates are then reacted with $H_2O_2$ at 20° to 100° C. or preferably $O_3$ in an inert solvent at −80° to 20° C. to yield the organosilane.

When $b$ is 2 in Formula I, a trihalovinylsilane of formula $X_3SiCH{=}CH_2$ (which is commercially available) is reacted with hydrogen bromide in the presence of peroxide or light to produce a beta-haloethyltrihalosilane. This compound is reacted with an alcohol and thereafter with an appropriate amine, phosphine, or sulfide in the manner discussed above for the preparation of the compounds of Formula I when $b$ is 3.

When $b$ is 1 in Formula I, the starting reactant is a commercially available trihalomethylsilane of formula $X_3SiCH_3$.

This silane is reacted with chlorine or, preferably a half mole of bromine and a half mole of chlorine in the presence of light (such as provided by an ordinary tungsten or fluorescent lamp). The resultant alphahalomethyltrihalosilane is reacted with an alcohol and thereafter an appropriate amine, phosphine or sulfide in the manner discussed above with the compounds of Formula I when $b$ is 3.

Examples of compounds illustrative of compounds of Formula I follow:

$(CH_3O)_3SiCH_2N^+(CH_3)_2C_{12}H_{25}$ $Cl^-$
$(C_2H_5O)_3SiCH_2N^+(CH_3)_2C_6H_5$ $Cl^-$
$(CH_3O)_3SiCH_2N^+(CH_3)_2C_{16}H_{33}$ $Cl^-$
$(C_2H_5O)_3Si(CH_2(_3N^+(C_2H_5)_2C_{10}H_{21}$ $Br^-$
$(C_3H_7O)_3SiCH_2N^+(C_3H_7)_2C_6H_4CH_3$ $Br^-$
$(C_2H_5O)_3Si(CH_2)_3N^+(CH_3)_2C_{18}H_{37}$ $Cl^-$
$(C_4H_9O)_3Si(CH_2)_2N^+(C_2H_5)$ $(CH_2C_6H_5)_2$ $Cl^-$
$(CH_3O)_3SiCH_2P^+(C_2H_5)_2C_{12}H_{25}$ $Cl^-$
$(C_2H_5O)_3Si(CH_2)_3P^+(C_4H_9)_2C_6H_5$ $Cl^-$
$(C_3H_7O)_3Si(CH_2)_2S^+(CH_3)C_6H_5$ $Cl^-$
$(CH_3O)_3SiCH_2CH_2S^+(C_2H_5)C_8H_{17}$ $Br^-$
$CH_3O)_3SiCH_2N^+(C_2H_4COOH)_2C_{10}H_{21}$ $Br^-$
$(C_2H_5O)_3Si(CH_2)_3N^+(CH_2COOH)$ $(CH_3)C_{12}H_{25}$ $Cl^-$
$(C_2H_5O)_3Si(CH_2)_2P^+(C_3H_6COOH)$ $(C_2H_5)C_{10}H_{21}$ $Cl^-$
$(C_4H_9O)_3SiCH_2S^+(C_3H_6COOH)C_6H_{13}$ $Br^-$
$(CH_3O)_3SiCH_2N^+(C_2H_4OH)_2C_8H_{17}$ $Cl^-$
$(C_4H_9O)_3Si(CH_2)_3P^+(C_4H_8OH)_2$ $C_6H_4CH_3$ $Cl^-$
$(C_2H_5O)_3SiCH_2S^+(C_3H_6OH)C_{10}H_{21}$ $Cl^-$
$(CH_3O)_3SiCH_2N^+(O)^-(CH_3)C_{12}H_{25}$
$(C_2H_5O)_3Si(CH_2)_3P^+(O)^-(C_2H_5)C_{12}H_{25}$
$(C_2H_5O)_3Si(CH_2)_2S^+(O)^-C_{10}H_{21}$
$(CH_3O)_3SiCH_2N^+[(C_2H_4O)_3H](CH_3)C_8H_{17}$ $Cl^-$
$(CH_3O)_3Si(CH_2)_2N^+[(C_4H_8O)_{15}CH_3](CH_3)C_6H_{13}$
$(C_2H_5O)_3Si(CH_2)_3N^+[(C_2H_4O)_6H]_2C_{10}H_{21}$ $Cl^-$
$(CH_3O)_3SiCH_2N^+[(C_2H_4O)_3COCH_3]_2C_8H_{17}$ $Cl^-$
$(C_3H_7O)_3SiCH_2P^+[(C_3H_6O)_{12}H]_2CH_2C_6H_5$ $Cl^-$
$(C_4H_9O)_3Si(CH_2)_3P^+[(C_2H_4O)_4C_3H_7](CH_3)_2$ $Br^-$
$(CH_3O)_3Si(CH_2)_2P^+[(C_2H_4O)_5COC_2H_5]_2C_4H_9$ $Br^-$
$(CH_3O)_3SiCH_2S^+[(C_2H_4O)_5H]C_{10}H_{21}$ $Cl^-$
$(C_2H_5O)_3Si(CH_2)_2S^+[(C_3H_6O)_8C_3H_7]CH_3$ $Br^-$
$(CH_3O)_3Si(CH_2)_3S^+[(C_2H_4O)_{12}COC_4H_9]CH_3$ $Cl^-$ $$(R_1O)_{3-a}-\overset{(R_2)_a}{\overset{|}{Si}}-(CH_2)_b-\overset{R_4}{\overset{|}{\underset{R_4}{\underset{|}{Y^+}}}}-R_5\ X^- \qquad \text{II.}$$

where $R_1$ is a $C_{1-4}$ alkyl group, $R_2$ is a $C_{1-18}$ alkyl group $a$ is 1 or 2, $b$ is 1-3, $R_4$ is a $C_{1-18}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{1-18}$ alkyl, aryl or arylalkyl group, X is halide, Y is N, S or P, and the sum of the carbon atoms in $R_2$, $R_5$ and $R_4$ when $R_4$ is alkyl, aryl, arylalkyl or carboxy-substituted alkyl, does not exceed 30.

The compounds of Formula II are prepared in a manner similar to the preparation of the compounds of Formula I except for the fact that the starting reactants (when $b$ is 1, 2, or 3) all have a $C_{1-18}$ alkyl group or two $C_{1-18}$ alkyl groups attached to the Si atom in place of a halogen atom(s). The starting reactant is commercially available when $R_2$ is $CH_3$. When $R_2$is $C_2H_5$ or greater, the compound is prepared by reacting a silane with an appropriate olefin. Thus, $X_{3-a}SiH_{1+a}$ is reacted with a $C_2$ to $C_{18}$ olefin to obtain the desired starting reactant. The remaining reaction steps and conditions for producing the desired organosilane of Formula II are essentially the same as for producing the compounds of Formula I.

Examples of compounds of Formula II are:

$(CH_3O)_2CH_3SiCH_2N^+(CH_3)_2C_{12}H_{25}$ $Cl^-$
$(C_2H_5O)_2C_6H_{13}Si(CH_2)_2N^+(CH_3)_2C_4H_9$ $Cl^-$
$(C_3H_7O)$ $(C_3H_7)_2Si(CH_2)_3N^+(C_2H_5)_2C_8H_{17}$ $Cl^-$
$(CH_3O)$ $(CH_3)_2SiCH_2P^+(CH_3)_2C_{10}H_{21}$ $Cl^-$
$(C_3H_7O)_2C_2H_5Si(CH_2)_2S^+(C_4H_9)C_6H_{12}C_6H_5$ $Cl^-$
$(CH_3O)_2C_8H_{17}Si(CH_2)_3N^+(C_2H_4COOH)$ $(CH_3)C_4H_9$ $Cl^-$
$(C_2H_5O)$ $(CH_3)_2Si(CH_2)_2P^+(CH_2COOH)_2C_{10}H_{21}$ $Cl^-$
$(C_3H_7O)_2CH_3SiCH_2S^+(C_3H_9COOH)C_6H_{13}$ $Cl^-$ $(CH_3O)_2CH_3SiCH_2N^+(C_2H_4OH)_2C_{12}H_{25}\ Cl^-$
$(C_3H_7O)\ (CH_3)_2SiCH_2P^+(C_3H_6OH)\ (C_4H_9)_2\ Br^-$ $(C_4H_9O)_2CH_3Si(CH_2)_3S^+(C_3H_6OH)CH_3\ Br^-$
$(CH_3O)_2CH_3SiCH_2N^+(O)^-(CH_3)C_{10}H_{21}$
$(CH_3O)_2C_{10}H_{21}Si(CH_2)_2P^+(O)^-(C_4H_9)_2$
$(C_4H_9O)\ (CH_3)_2Si(CH_2)_3S^+(O)^-C_8H_{17}$
$(CH_3O)\ _2CH_3SiCH_2N^+](C_3H_6O)_{20}H]_2C_6H_5\ Cl^-$
$(CH_3O)_2C_2H_5Si(CH_2)_2N^+[(C_4H_8O)_6C_2H_5]_2CH_3\ Cl^-$
$(C_2H_5O)\ (CH_3)_2SiCH_2P^+[(C_2H_4O)_2H]\ (C_6H_5)_2\ Cl^-$
$(C_2H_5O)\ _2C_8H_{17}Si(CH_2)_3P^+[(C_2H_4O)_4C_3H_7]_2C_4H_9\ Cl^-$
$(CH_3O)_2CH_3SiCH_2P^+[(C_2H_4O)_6COCH_3[_2C_8H_{17}\ Cl^-$
$(CH_3O)_2CH_3SiCH_2S^+[(C_3H_6O)_2H]C_6H_{13}\ Cl^-$
$(C_2H_5O)\ (C_2H_5)_2Si(CH_2)_3S^+[(C_2H_4O)_5CH_3]C_8H_{17}\ Br^-$
$(C_2H_5O)_2C_{10}H_{21}SiCH_2N^+[(C_2H_4O)_2COC_2H_5](C_4H_9)_2\ Cl^-$
$(CH_3O)_2C_4H_9Si(CH_2)_2S^+[(C_2H_4O)_2COCH_3]C_{12}H_{25}\ Br^-$

Compounds of Formulas I and II when $R_4$ is an alkyl, aryl, arylalkyl group or oxygen are disclosed in British Pats. No. 686,068 and 882,053 and U.S. Pats. No. 2,955,127, 3,557,178, 3,730,701 and 3,817,739. Compounds of Formulas I and II when $R_4$ is a carboxy-substituted alkyl group or $(C_xH_{2x}O)_mZ$ are disclosed in commonly assigned copending patent application "Organosilane Compounds" by Heckert and Watt, U.S. Ser. No. 570,532 filed Apr. 22, 1975. (The disclosure of this application is herein incorporated by reference.)

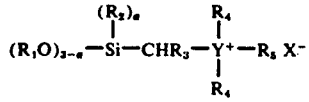

III.

wherein $R_1$ is a $C_{1-4}$ alkyl group, $a$ is 0 to 2, $R_2$ is a $C_{1-18}$ alkyl group, $R_3$ is a $C_{1-12}$ alkyl group, $R_4$ is a $C_{1-18}$ alkyl, aryl or arylalkyl group, a carboxy-substituted $C_{1-4}$ alkyl group, $(C_xH_{2x}O)_mZ$ where $x$ is 2–4, $m$ is 1–20, is Z is hydrogen, a $C_{1-3}$ alkyl group or a $C_{1-4}$ acyl group, or oxygen provided only one $R_4$ is oxygen, $R_5$ is a $C_{1-18}$ alkyl, aryl or arylalkyl group, X is halide, Y is N, S or P and the sum of the carbon atoms in $R_2$, $R_3$, $R_5$ and $R_4$ when $R_4$ is alkyl, aryl, arylalkyl or carboxy-substituted alkyl does not exceed 30.

The compounds of Formula III when $a$ is 0 and $R_4$ is an alkyl group are prepared by the following route:

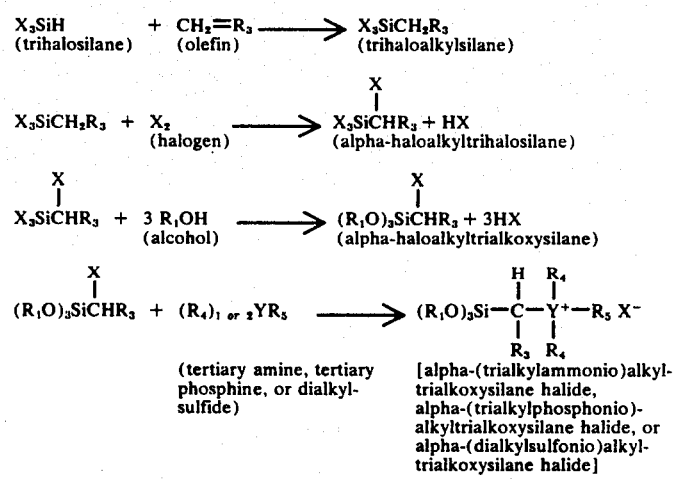

The trihalosilane is reacted with an olefin at 100° C. for 4 to 10 hours under a pressure of 50 to 300 psi. in the presence of a chloroplatinic acid or platinum catalyst to produce the trihaloalkylisilane. This reaction is reported by F. P. Mackay, O. W. Steward and P. G. Campbell in "Journal of the American Chemical Society," 79, 2764 (1957) and J. L. Speier, J. A. Webster and S. W. Barnes in Journal of the American Chemical Society, 79, 974 (1957). The trihaloalkylsilane is then halogenated in a known manner by treating it with halogen in the presence of light (such as that provided by ordinary tungsten or fluorescent lamps). Preferably, halogenation is carried out to only partial completion and a distillation is performed to recycle unreacted alkylsilane. The remaining reactions are the same as those described above in connection with the preparation of the compounds of Formula I.

When $a$ is 1 or 2, the preparation of the compounds is essentially the same except for the use of an alkyl substituted silane as the starting reactant.

When $R_4$ is a carboxy-substituted $C_{1-4}$ alkyl group, oxygen or $(C_xH_{2x}O)_mZ$ where $x$ is 2–4, $m$ is 1–20, and Z is hydrogen, a $C_{1-3}$ alkyl group, or a $C_{1-4}$ acyl group, an appropriate amine, phosphine, or sulfide is used in the reaction step as discussed above for the preparation of similarly substituted compounds of Formula I.

The compounds that follow are illustrative of compounds of Formula III.

$(C_2H_5O)_3SiCH(C_8H_{17})N^+(CH_3)_2C_8H_{17}\ Cl^-$
$(CH_3O)_3SiCH(C_{10}H_{21})N^+(C_2H_4)_2CH_3\ Cl^-$
$(C_3H_7O)_2CH_3SiCH(C_{12}H_{25})N^+(C_2H_4OH)\ (CH_3)_2\ Cl^-$
$(C_4H_9O)_3SiCH(C_3H_7)N^+[(C_2H_4O)_{10}H]_2C_6H_{13}\ Br^-$
$(CH_3O)_3SiCH(C_{10}H_{21})N^+[(C_2H_4O)_2C_3H_7]_{(CH3)}C_6H_5\ Br^-$
$(CH_3O)_3SiCH(CH_3)N^+[(C_2H_4O)_3COC_2H_5](C_2H_5)_2\ Br^-$
$(C_2H_5O)_2CH_3SiCH(C_8H_{17})N^+(O)^-(CH_3)_2$
$(CH_3O)_3SiCH(C_8H_{17})P^+(CH_3)_3\ Cl^-$
$(CH_3O)_2CH_3SiCH(CH_3)P^+(C_3H_6COOH)_2C_2H_4C_6H_5\ Cl^-$
$(C_2H_5O)_3SiCH(C_{10}H_{21})P^+(C_2H_4OH)C_4H_9\ Cl^-$
$(CH_3O)_3SiCH(C_3H_7)P^+(O)^-(CH_3)C_{12}H_{25}$ $(CH_3O)_3SiCH(C_8H_{17})P^+[(C_2H_4O)_6H]_2CH_3\ Cl^-$
$(C_2H_5O)_3SiCH(C_6H_{13})P^+[(C_3H_6O)_2C_2H_5](CH_3)_2\ Cl^-$
$(CH_3O)_3SiCH(CH_3)S^+(CH_3)C_{10}H_{21}\ Br^-$
$(C_2H_5O)_2CH_3SiCH(C_{12}H_{25})S^+(C_3H_6COOH)CH_3\ Cl^-$
$(CH_3O)_2C_{12}H_{25}SiCH(C_2H_5)S^+(C_2H_4OH)C_2H_5\ Cl^-$
$(CH_3O)_3SiCH(C_{10}H_{21})S^+(O)^-C_5H_{11}$
$(C_2H_5O)_3SiCH(C_4H_9)S^+[(C_3H_6O)_{10}H]C_6H_5\ Cl^-$
$(C_2H_5O)_3SiCH(CH_3)S^+[(C_2H_4O)_{20}C_2H_5]CH_3\ Br^-$

Commonly assigned copending patent application "Organosilane Compounds" by Heckert and Watt, U.S. Ser. No. 570,537 filed Apr. 22, 1975 discloses the preparation of these compounds. (The disclosure of this application is herein incorporated by reference).

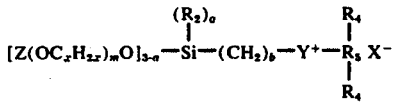

IV.

wherein Z is hydrogen, a $C_{1-3}$ alkyl group or a $C_{1-4}$ acyl group, $x$ is 2–4, $m$ is 1–20, $a$ is 0–2, $R_2$ is a $C_{1-18}$ alkyl group, $b$ is 1–3, $R_4$ is a $C_{1-18}$ alkyl, aryl or arylalkyl group, a carboxy-substituted $C_{1-4}$ alkyl group $(C_xH_{2x}O)_mZ$ where $x$, $m$ and Z are as defined above, or oxygen provided only one $R_4$ is oxygen, $R_5$ is a $C_{1-18}$ alkyl, aryl or arylalkyl group, X is a halide, Y is N, S or P and the sum of the carbon atoms in $R_2$, $R_5$ and $R_4$ when $R_4$ is alkyl, aryl, arylalkyl or carboxy-substituted alkyl does not exceed 30.

The compounds with Formula IV are prepared in substantially the same manner as those of Formula II with the exception that the $R_1OH$ used in the alcoholysis step is $Z(OC_xH_{2x})_mOH$ or alternatively the compounds of Formula II are heated in the presence of $Z(OC_xH_{2x})_mOH$ under conditions such that $R_1OH$ is removed from the system.

Exemplary compounds of Formula IV are as follows:
$[CH_3(OC_2H_4)O]_3SiCH_2N^+(CH_3)_2C_{12}H_{25}\ Cl^-$
$[CH_3(OC_2H_4)_5O]_2CH_3Si(CH_2)_3N^+(CH_2COOH)_2C_{10}H_{21}\ Cl^-$
$[H(OC_3H_6)_3O]_3SiCH_2N^+(C_2H_4OH)\ (CH_3)\ (C_{12}H_{25})\ Cl^-$
$[H(OC_2H_4)_{18}O]_3Si(CH_2)_2N^+(O)^-(CH_3)C_{10}H_{21}$
$[CH_3CO(OC_2H_4)_{10}O]_3SiCH_2N^+[(C_2H_4O)_{14}H]_2C_6H_{12}C_6H_5\ Cl^-$
$[C_3H_7(OC_2H_4)_8O]_2C_6H_{13}SiCH_2N^+[(C_3H_6O)CH_3](CH_3)_2\ Br^-$
$[H(OC_4H_8)_8O]_3SiCH_2N^+[(C_2H_4O)_4COCH_3]_2CH_3\ Cl^-$
$[C_2H_5(OC_2H_4)_2O]_3Si(CH_2)_2P^+(CH_3)_2C_{10}H_{21}\ Br^-$
$[CH_3(OC_3H_6)_{14}O]_3SiCH_2P^+(C_2H_4COOH)\ (C_6H_{13})_2\ Cl^-$
$[C_2H_5(OC_2H_4)O]_2CH_3Si(CH_2)_2P^+(C_4H_8OH)(CH_3)C_6H_5\ Cl^-$
$[CH_3(OC_2H_4)_8O]_3SiCH_2P^+(O)^-(CH_3)C_8H_{17}$
$[C_2H_5OC(OC_2H_4)_2O]_3Si(CH_2)_3P^+[C_2H_4O)_8H]_2C_6H_{13}\ Cl^-$
$[CH_3(OC_4H_8)O]_3SiCH_2P^+[(C_3H_6O)_2C_3H_7](C_4H_9)_2\ Br^-$
$[C_2H_5OC(OC_2H_4)O]_3SiCH_2S^+(CH_3)C_8H_{17}\ Cl^-$
$[H(OC_2H_4)_4O]_3Si(CH_2)_2S^+(C_2H_4COOH)C_{12}H_{25}\ Br^-$
$[CH_3(OC_2H_4)_{20}O]_3Si(CH_2)_3S^+(C_3H_6OH)C_{12}H_{25}\ Br^-$
$[H(OC_3H_6)_{12}O]_3Si(CH_2)_2S^+(O)^-C_5H_{11}$
$[C_2H_5(OC_2H_4)_4O]_3SiCH_2S^+[(C_2H_4O)_{20}H]CH_3\ Br^-$
$[H(OC_2H_4)_{12}O]_3Si(CH_2)_3S^+[(C_2H_4O)C_3H_7]C_6H_4CH_3\ Cl^-$ Commonly assigned copending patent application "Organosilane Compounds" by Heckert and Watt, U.S. Ser. No. 570,539 filed Apr. 22, 1975 discloses the preparation of these compounds. (The disclosure of this application is herein incorporated by reference.)

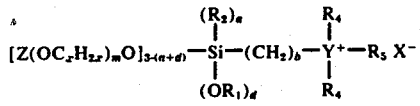

V.

wherein Z is hydrogen, a $C_{1-3}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided a+d does not exceed 2, $b$ is 1–3, $R_4$ is a $C_{1-18}$ alkyl, aryl or arylalkyl group, a carboxy-substituted $C_{1-4}$ alkyl group, $(C_xH_{2x}O)_mZ$ where $x$, $m$ and Z are as defined above, or oxygen provided only one $R_4$ is oxygen, $R_5$ is a $C_{1-18}$ alkyl, aryl or aryl alkyl group, X is halide, Y is N, S or P and sum of the carbon atoms in $R_2$, $R_5$ and $R_4$ when $R_4$ is alkyl, aryl, arylalkyl or carboxy-substituted alkyl does not exceed 30.

The compounds of Formula V are formed in substantially the same manner as those of Formula II except that a mixture of $R_1OH$ and $Z(OC_xH_{2x})_mOH$ in the desired ratio is used in place of $R_1OH$ or, alternatively, the compounds of Formula II are heated with less than 3-$a$ equivalents of $Z(OC_xH_{2x})_mOH$ under conditions such that $R_1OH$ is removed from the system.

Examples of illustrative compounds follows:
$[H(OC_2H_4)_5O](CH_3)\ (C_2H_5O)SiCH_2N^+(CH_3)_2C_{12}H_{25}\ Cl^-$
$[C_3H_7(OC_2H_4)_3O](CH_3O)_2Si(CH_2)_3N^+(C_2H_5)_2C_6H_5\ Cl^-$
$[H(OC_4H_8)_6O](C_2H_5O)_2Si(CH_2)_3N^+[(C_2H_4O)_{10}H]_2C_{12}H_{25}\ Br^-$
$[CH_3CO(OC_2H_4)_3O]_2(C_2H_5O)Si(CH_2)_2N^+[(C_2H_4O)C_2H_5]_2(C_6H_5CH_3)\ Cl^-$
$[H(OC_2H_4)_{12}O](C_4H_9O)_2SiCH_2N^+[(C_2H_4O)_4COCH_3]_2C_{10}H_{21}\ Cl^-$
$[C_2H_5(OC_2H_4)_3O](C_2H_5)\ (CH_3O)SiCH_2N^+(O)^-(CH_3)C_6H_{13}$
$[H(OC_3H_6)_{12}O](C_2H_5O)_2SiCH_2N^+(C_2H_5COOH)(CH_3)C_{10}H_{21}\ Cl^-$
$[C_2H_5(OC_2H_4)_{14}O]_2(C_4H_9O)Si(CH_2)_3N^+(C_4H_8OH)(CH_3)C_7H_{15}\ Cl^-$
$[H(OC_2H_4)_{16}O]_2(CH_3O)SiCH_2P^+(CH_3)_2C_6H_4C_2H_5\ Cl^-$
$[C_3H_7(OC_2H_4)_6O](C_2H_5)\ (CH_30)SiCH_2P^+[(C_2H_4O)_8H]_2C_8H_{17}\ Br^-$
$[CH_3OC(OC_2H_4)_2O]_2(CH_3O)Si(CH_2)_2P^+[(C_3H_6O)_3C_2H_5](C_4H_9)_2\ Cl^-$
$[H(OC_4H_8)_2O](C_{12}H_{25})\ (CH_3O)SiCH_2P^+(O)^-(CH_3)C_6H_5$ $[C_2R_5(OC_2H_4)_6O](CH_3O)_2SiCH_2P^+(C_3H_6)_2CH_3\ Cl^-$
$[H(OC_2H_4)_8O]_2(C_4H_9O)SiCH_2P^+(C_3H_6OH)_2C_2H_5\ Br^-$
$[H(OC_2H_4)_{10}O]_2(C_3H_7O)SiCH_2S^+(CH_3)C_6H_{12}C_6H_5\ Cl^-$
$[H(OC_4H_8)_2O]_2(CH_3O)Si(CH_2)_3S^+[(C_2H_4O)_4H]CH_3\ Br^-$
$[C_3H_7(OC_2H_4)_6O](CH_3)\ (CH_3O)SiCH_2S^+[(C_3H_6O)_8CH_3]C_3H_7\ Cl^-$
$[CH_3CO(OC_2H_4)_3O](C_2H_5O)_2Si(CH_2)_2S^+(C_2H_4OH)C_{12}H_{25}\ Cl^-$
$[CH_3(OC_3H_6)_{12}0](CH_3O)_2SiCH_2S^+(C_3H_6COOH)CH_2C_6H_5\ Br^-$
$[H(C_2H_4O](C_{12}H_{25})(CH_3O)SiCH_2S^+(O)^-C_6H_{13}$ Commonly assigned copending patent application "Organosilane Compounds" by Heckert and Watt, U.S. Ser. No. 570,539 filed Apr. 22, 1975 discloses the preparation of these compounds. (The disclosure of this application is herein incorporated by reference.)

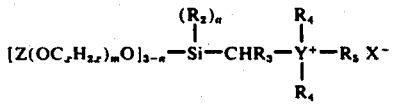

VI.

wherein Z is hydrogen, a $C_{1-3}$ alkyl group or a $C_{1-4}$ acyl group, $x$ is 2–4, $m$ is 1–20, $a$ is 0–2, $R_2$ is a $C_{1-18}$ alkyl group, $R_3$ is a $C_{1-18}$ alkyl grup, $R_4$ is a $C_{1-18}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{1-18}$ alkyl, aryl or arylalkyl group, X is halide, Y is N, S or P and the sum of the carbon atoms in $R_2$, $R_3$, $R_5$ and $R_4$ when $R_4$ is alkyl, aryl, arylalkyl or carboxy-substituted alkyl does not exceed 30.

The compounds of Formula VI are formed in the same manner as those of Formula III with the exception that $Z(OC_xH_{2x})_mOH$ is used in place of $R_1OH$ during the alcoholysis of the halo-silane. Alternatively, preparation may be effected by the heating of compounds of Formula III with $Z(OC_xH_{2x})_mOH$ under conditions such that all of the $R_1OH$ is removed from the system.

The following compounds illustrate the compounds of Formula VI.

$[CH_3(OC_2H_4)_3O]_3SiCH(CH_3)N^+(CH_3)_2C_8H_{17}\ Cl^-$
$[C_2H_5(OC_2H_4)O]_2CH_3SiCH(C_2H_5)N^+(C_2H_4OH)_2C_{12}H_{25}\ Cl^-$
$[H(OC_4H_8)_8O]_3SiCH(C_4H_9)N^+(C_2H_4COOH)(C_4H_9)CH_2C_6H_5\ Cl^-$
$[CH_3CO(OC_2H_4)_2O]_3SiCH(C_2H_5)N^+(O)^-(CH_3)C_{10}H_{21}$
$[H(OC_3H_6)_6O]_3SiCH(C_{12}H_{25})N^+[(C_2H_4O)_{10}H]_2CH_3\ Br^-$
$[C_3H_7(OC_2H_4)O]_3SiCH(C_3H_7)N^+[(C_4H_8O)_3C_3H_7](C_2H_5)_2\ Cl^-$
$[C_2H_5(OC_2H_4)_4O]_3SiCH(C_2H_5)N^+[(C_2H_4O)_6COCH_3]_2CH_3\ Cl^-$
$[H(OC_2H_4)_{16}O]_3SiCH(C_4H_9)P^+(C_2H_5)_2C_6H_4C_4H_9\ Cl^-$
$[CH_3(OC_2H_4)_{16}O]_2C_4H_9SiCH(CH_3)P^+(C_3H_6COOH)_2C_5H_{11}\ Cl^-$
$[C_2H_5OC(OC_2H_4)_5O]_3SiCH(CH_3)P^+(C_2H_4OH)(CH_3)C_{12}H_{25}\ Cl^-$
$[H(OC_2H_4)_2O]_3SiCH(C_{10}H_{25})P^+(O)^-(CH_3)C_6H_{13}$
$[H(OC_2H_4)_2O]_3SiCH(C_8H_{17})P^+[(C_2H_4O)_6H]_2C_4H_9\ Br^-$
$[CH_3(OC_4H_8)_2O]_3SiCH(CH_3)P^+[(C_2H_4O)C_2H_5](CH_3)_2\ Cl^-$
$[C_2H_5(OC_2H_4)_2O]_3SiCH(C_6H_{13})S^+(CH_3)C_{10}H_{21}\ Cl^-$
$[H(OC_2H_4)_{14}O]_2CH_3SiCH(C_8H_{17})S^+(C_2H_4COOH)C_6H_{13}\ Cl^-$
$[H(OC_3H_6)_4O]_3SiCH(C_{12}H_{25})S^+(C_4H_8OH)C_6H_5\ Cl^-$
$[CH_3CO(OC_2H_4)_3O]_3SiCH(C_2H_5)S^+(O)^-C_{12}H_{25}$
$[C_3H_7(OC_2H_4)O]_3SiCH(C_3H_7)S^+[(C_3H_6O)H]C_6H_{13}\ Cl^-$
$[H(OC_4H_8)_4O]_2CH_3SiCH(C_4H_9)S^+[C_2H_4O)_8C_3H_7]CH_3\ Br^-$

Commonly assigned copending patent application "Organosilane Compounds" by Heckert and Watt, U.S. Ser. No. 570,537 filed Apr. 22, 1975 discloses the preparation of these compounds. (The disclosure of this application is herein incorporated by reference.)

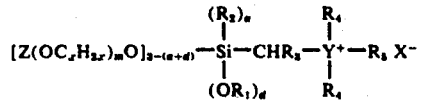

VII.

wherein Z is hydrogen, a $C_{1-3}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided $a+d$ does not exceed 2, $R_3$ is a $C_{1-18}$ alkyl group, $R_4$ is a $C_{1-18}$ alkyl, aryl or arylalkyl group, a carboxy-substituted $C_{1-4}$ alkyl group, $(C_xH_{2x}O)_mZ$ where $x$, $m$ and Z are as defined above, or oxygen provided only one $R_4$ is oxygen, $R_5$ is a $C_{1-18}$ alkyl, aryl or arylalkyl group, X is halide, Y is N, S or P and the sum of the carbon atoms in $R_2$, $R_3$, $R_5$ and $R_4$ when $R_4$ is alkyl, aryl, arylalkyl or carboxy-substituted alkyl does not exceed 30.

Compounds having Formula VII are prepared in substantially the same manner as those of Formula III except that a mixture of $R_1OH$ and $Z(OC_xH_{2x})_mOH$ in the desired ratio is used in place of $R_1OH$. Alternatively, the compounds of Formula III are heated together with less than $3-a$ equivalents of $Z(OC_xH_{2x})_mOH$ under conditions such that $R_1OH$ is removed from the system.

The following compounds are illustrative of the compounds of Formula VII:

$[H(OC_2H_6)_6O](C_2H_5O)_2SiCHC_{12}H_{25}N^+[(C_2H_4O)_{10}H]_2C_6H_{13}\ Br^-$
$[CH_3CO(OC_2H_4)_3O]_2(C_2H_5O)SiCHCH_3N^+[(C_2H_4O)C_2H_5]_2C_6H_5CH_3\ Cl^-$ $[H(OC_2H_4)_{12}O](C_4H_8O)_2SiCHC_2H_5N^+[(C_2H_4O)_4COCH_3]_2C_{10}H_{21}$ $Cl^-$ $[C_3H_7(OC_2H_4)_3O](C_2H_5)(CH_3O)SiCHCH_3N^+(O)^-(CH_3)C_6H_{13}$ $[C_2H_5(OC_2H_4)_{14}O]_2(C_4H_9O)SiCHC_6H_{13}N^+(C_6H_{12}OH)(CH_3)C_5H_{11}$ $Cl^-$ $[H(OC_2H_4)_{16}O]_2(CH_3O)SiCHC_4H_9P^+(CH_3)_2C_{12}H_{25}$ $Cl^-$ $[CH_3CO(OC_2H_4)_2O]_2(CH_3O)SiCHC_{10}H_{21}P^+[(C_3H_7O)_3C_2H_5](C_4H_9)_2$ $Cl^-$ $[C_2H_5(OC_2H_4)_6O](CH_3O)_2SiCHCH_3P^+(C_3H_6COOH)_2CH_3$ $Cl^-$ $[H(OC_2H_4)_{10}O]_2(C_3H_7O)SiCHC_5H_{11}S^+(CH_3)C_{12}H_{25}$ $Cl^-$ $[H(OC_4H_8)_2O]_2(CH_3O)SiCHC_8H_{17}S^+CH_3C_6H_5$ $Br^-$

Commonly assigned copending patent application "Organosilane Compounds" by Heckert and Watt, U.S. Ser. No. 570,537 filed Apr. 22, 1975 discloses the preparation of the compounds. (The disclosure of this application is herein incorporated by reference.)

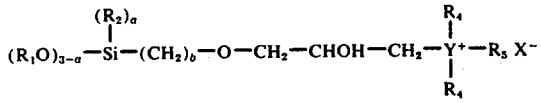

wherein $R_1$ is a $C_{1-4}$ alkyl group, $a$ is 0–2, $R_2$ is a $C_{1-18}$ alkyl group, $b$ is 1–3, $R_4$ is a $C_{1-18}$ alkyl, aryl or arylalkyl group, a carboxy-substituted $C_{1-4}$ akyl group, $(C_xH_{2x}O)_mZ$ where $x$ is 2–4, $m$ is 1–20, and Z is hydrogen, a $C_{1-3}$ alkyl group or a $C_{1-4}$ acyl group, or oxygen provided only one $R_4$ is oxygen, $R_5$ is a $C_{1-18}$ alkyl, aryl or arylalkyl group, X is halide, Y is N, S or P and the sum of the carbon atoms in $R_2$, $R_5$ and $R_4$ when $R_4$ is alkyl, aryl, arylalkyl or carboxy-substituted alkyl does not exceed 30.

The compounds of Formula VIII are prepared by initially reacting (when $a$ is 0 and $b$ is 3) trihalosilane with an alcohol ($R_1OH$) at 0° to 50° C. for 1 to 10 hours to produce a trialkoxysilane. This silane is then reacted with an allylglycidylether

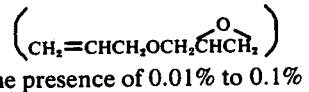

in the presence of 0.01% to 0.1% chloroplatinic acid or platinum at 100° C. for 2 to 10 hours. The resultant product

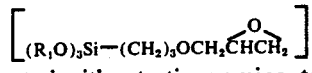

is reacted with a tertiary amine, tertiary phosphine, or dialkylsulfide in the presence of an acid in an inert solvent at 60° C. to 100° C. for 1 to 10 hours to produce the compound of Formula X. $R_4$ is an alkyl group, carboxy-substituted alkyl group, oxygen or a $(C_xH_{2x}O)_mZ$ group as defined above.

When $a$ is 1 or 2, the preparation of the compounds is essentially the same except for the use of an alkyl substituted silane as the starting reactant.

When $b$ is 2 in Formula VIII, a trihalovinylsilane of formula $X_3SiCH{=}CH_2$ (which is commercially available) is reacted with hydrogen bromide in the presence of peroxide or light to produce a beta-haloethyltrihalosilane. This compound is reacted with an alcohol, an allylglycidylether, and finally with an appropriate amine, phosphine, or sulfide in the manner discussed above for the preparation of the compounds of Formula VIII when $b$ is 3.

When $b$ is 1 in Formula VIII, the starting reactant is a commercially available trihalomethylsilane of formula $X_3SiCH_3$ This silane is reacted with chlorine or, preferably a half mole of bromine and a half mole of chlorine in the presence of light (such as provided by an ordinary tungsten or fluorescent lamp). The resultant alpha-halomethyltrihalosilane is reacted with an alcohol, an allylglycidylether, and finally an appropriate amine, phosphine or sulfide in the manner discussed above with the compounds of Formula VIII when $b$ is 3.

VIII.

The following compounds illustrate the compounds of Formula VIII.

$(CH_3O)_3Si(CH_2)_3OCH_2CHOHCH_2N^+(CH_3)_2C_{12}H_{25}$ $Cl^-$ $(CH_3O)_2C_2H_5SiCH_2OCH_2CHOHCH_2N^+(C_3H_6COOH)(C_4H_9)C_8H_{17}$ $Cl^-$ $2H_5O)_3Si(CH_2)_2OCH_2CHOHCH_2N^+(C_2H_4OH)_2C_6H_5$ $Br^-$ $(CH_3O)_3Si(CH_2)_3OCH_2CHOHCH_2N^+(O)^-(CH_3)C_8H_{17}$ $(CH_3O)_3SiCH_2OCH_2CHOHCH_2N^+[(C_2H_4O)H]_2C_{10}H_{21}$ $Br^-$ $(CH_3O)_2C_2H_5SiCH_2OCH_2CHOHCH_2N^+[(C_3H_6O)_{12}C_2H_5](CH_3)_2$ $Cl^-$ $(C_4H_9O)_3SiCH_2OCH_2CHOHCH_2N^+[(C_2H_4O)_3COCH_3]_2CH_3$ $Br^-$ $(CH_3O)_3SiCH_2OCH_2CHOHCH_2P^-(C_4H_9)_2CH_2C_6H_5$ $Br^-$ $(C_4H_9O)_3SiCH_2OCH_2CHOHCH_2P^+(C_2H_4COOH)_2C_8H_{17}$ $Cl^-$ $(CH_3O)_3Si(CH_2)_2OCH_2CHOHCH_2P^+(C_2H_4OH)(C_2H_5)C_{10}H_{21}$ $Cl^-$ $(CH_3O)_3SiCH_2OCH_2CHOHCH_2P^+(O)^-(CH_3)C_{10}H_{21}$ $(CH_3O)_3SiCH_2OCH_2CHOHCH_2P^+[C_3H_6O)_{18}H]_2CH_3$ $Br^-$ $(C_2H_5O)(CH_3)_2SiCH_2OCH_2CHOHCH_2P^+[(C_2H_4O)CH_3]_2C_6H_{13}$ $(CH_3O)_3SiCH_2OCH_2CHOHCH_2S^+(CH_3)C_6H_4CH_3$ $Cl^-$ $(CH_3O)_2C_7H_{15}SiCH_2OCH_2CHOHCH_2S^+(C_2H_4COOH)C_8H_{17}$ $Cl^-$ $(CH_3O)_3Si(CH_2)_2OCH_2CHOHCH_2S^+(C_2H_4OH)C_6H_{13}$ $Cl^-$ $(C_2H_5O)_3SiCH_2OCH_2CHOHCH_2S^+(O)^-C_{10}H_{21}$ $(CH_3O)_3SiCH_2OCH_2CHOHCH_2S^+[(C_2H_4O)_{12}H]CH_3$ $Br^-$ $(C_2H_5O)_3SiCH_2OCH_2CHOHCH_2S^+[(C_2H_4O)_2C_3H_7]C_2H_5$ $Br^-$

Commonly assigned copending patent application "Organosilane Compounds" by Heckert and Watt, U.S. Ser. No. 570,531 filed Apr. 22, 1975 discloses the preparation of these compounds. (The disclosure of this application is herein incorporated by reference.)

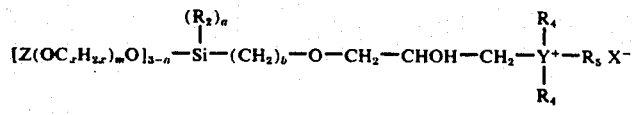

IX.

wherein Z is hydrogen, a $C_{1-3}$ alkyl group or a $C_{1-4}$ acyl group *x* is 2–4, *m* is 1–20, *a is* 0–2, $R_2$ is a $C_{1-18}$ alkyl group, *b* is 1–3, $R_4$ is a $C_{1-18}$ alkyl, aryl or arylalkyl group, a carboxy-substituted $C_{1-4}$ alkyl group $(C_xH_{2x}O)_mZ$ where *x* is 2–4, *m* is 1–20, and Z is hydrogen, a $C_{1-3}$ alkyl group or a $C_{1-4}$ acyl group, or oxygen provided only one $R_4$ is oxygen, $R_5$ is a $C_{1-18}$ alkyl, aryl or arylalkyl group, X is a halide, Y is N, S or P and the sum of the carbon atoms in $R_2$, $R_5$, and $R_4$ when $R_4$ is alkyl, aryl, arylalkyl or carboxy-substituted alkyl does not exceed 30.

Compounds of Formula IX are prepared in a manner identical with that of Formula VIII except that $R_1OH$ is replaced by $HO(C_xH_{2x}O)_mZ.$ The following compound are exemplary of Formula IX compounds.

$[H(OC_2H_4)_{20}O]_3SiCH_2OCH_2.CHOHCH_2N^+(CH_3)_2C_{10}H_{21}\ Cl^-$ $[CH_3(OC_3H_6)_{10}O]_2CH_3SiCH_2OCH_2.CHOHCH_2N^+(C_2H_4COOH)(C_4H_9)_2\ Cl^-$ $[C_2H_5(OC_2H_4)_2O]_3Si(CH_2)_3OCH_2CHOHCH_2N^+(C_2H_4OH)_2(C_8H_{17})\ Cl^-$ $[C_3H_7(OC_2H_4)O]_3SiCH_2OCH_2CHOHCH_2N^+(O)^-(C_4H_9)C_6H_5$ $[CH_3CO(OC_2H_4)_6O]_6O]_3Si(CH_2)_2OCH_2.CHOHCH_2N^+[(C_2H_4O)_{10}H]_2CH_3\ Cl^-$ $[H(OC_3H_6)_8O]_2C_{12}H_{25}SiCH_2OCH_2CHOHCH_2N^+[(C_2H_4O)_8C_3H_7](CH_3)_2\ Br^-$ $[C_2H_5(OC_2H_4)_4O]_3SiCH_2OCH_2CHOHCH_2N^+[(C_2H_4O)_2COCH_3]_2CH_3\ Br^-$ $[C_2H_5(OC_2H_4)_3O]_3SiCH_2OCH_2.CHOHCH_2P^+(C_2H_5)_2C_8H_{17}\ Cl^-$ $[H(OC_3H_6)_8]_3Si(CH_2)_3OCH_2CHOHCH_2P^+(C_3H_6COOH)_2C_6H_{13}Cl^-$ $[C_2H_5(OC_2H_4)_2O]_2O]_2CH_3OCH_2CHOHCH_2p^+(C_2H_4OH)(CH_3(C_8H_{17}\ Cl^-$ $[CH_3(OC_3H_6)O]_3Si(CH_2)_3OCH_2CHOHCH_2P^+(O)^-(CH_3)C_{10}H_{21}$ $[C_2H_5(OH_4C_2)_{12}O]_3Si(CH_2)_2OCH_2CHOHCH_2P^+[(C_2H_4O)_2H]_2C_6H_4CH_3\ Br^-$ $[CH_3CO(OC_2H_4)_8O]_3SiCH_2OCH_2CHOHCH_2P^+[(C_3H_6O)_8C_2H_5](C_4H_9)_2\ Cl^-$ $[H(OC_2H)_4O]_3SiCH_2OCH_2CHOHCH_2S^+(CH_3)C_{11}H_{23}\ Cl^-$ $[C_2H_5(OC_2H_4)_6O]_2C_4H_9SiCH_2OCH_2.CHOHCH_2S^+(C_3H_6COOH)C_{10}H_{21}\ Cl^-$ $[CH_3(OC_4H_8)_4O]_3SiCH_2OCH_2CHOHCH_2S^+(C_4H_8OH)C_8H_{17}\ Br^-$ $[H(OC_2H_4)_{14}O]_3Si(CH)_2OCH_2CHOHCH_2S^+(O)^-C_6H_{12}C_6H_5$ $[C_3H_7(OC_2H_4)O]_3SiCH_2OCH_2CHOHCH_2S^+[(C_2H_4O)_6H]C_6H_{13}\ Cl^-$ $[C_2H_5CO(OC_2H_4)_2O]_3SiCH_2OCH_2CHOHCH_2S^+[(C_4H_8O)_{12}CH_3]C_8H_{17}\ Cl^-$

Commonly assigned copending patent application "Organosilane Compounds" by Heckert and Watt, U.S. Pat. No. 570,539 filed Apr. 22, 1975 discloses the preparation of these compounds. (The disclosure of this application is herein incorporated by reference.)

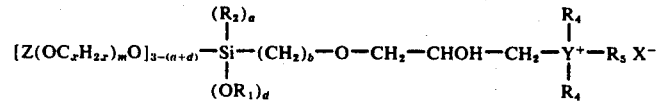

X.

wherein Z is hydrogen, a $C_{1-3}$ alkyl group or a $C_{1-4}$ acyl group, *x* is 2–4, *m* is 1–20, $R_2$ is a $C_{1-18}$ alkyl group, $R_1$ is a $C_{1-4}$ alkyl group, *a* is 0 or 1, *d* is 1 or 2 provided a+d does not exceed 2, *b* is 1–3, $R_4$ is a $C_{1-18}$ alkyl, aryl or arylalkyl group, a carboxy-substituted $C_{1-4}$ alkyl group, $(C_xH_{2x}O)_mZ$ where *x*, *m* and Z are as defined above, or oxygen provided only one $R_4$ is oxygen, $R_5$ is a $C_{1-18}$ alkyl, aryl or arylalkyl group, X is halide, Y is N, S or P and the sum of the carbon atoms in $R_2$, $R_5$ and $R_4$ when $R_4$ is alkyl, aryl, arylalkyl or carboxy-substituted alkyl does not exceed 30.

These compounds are prepared in a manner similar to that described for the compounds of Example IX except that only a part of the $R_1OH$ is replaced by $HO(C_xH_{2x}O)_mZ.$ The following compounds are examples of compounds having the Formula X.

$[H(OC_2H_4)_{12}O](CH_3O)_2SiCH_2OCH_2.CHOHCH_2N^+(CH_3)_2C_{12}H_{25}\ Cl^-$ $[H(OC_3H_6O)_3O](C_2H_5O)(CH_3Si(CH_2)_2OCH_2.CHOHCH_2N^+(CH_2COOH)(C_4H_9)_2\ Cl^-$ $[C_2H_5(OC_2H_4)_9O](C_2H_5O)_2SiCH_2OCH_2.CHOHCH_2N^+(C_6H_8OH)_2CH_3\ Cl^-$ $[CH_3(OC_4H_8)_2O]_2(C_4H_9O)Si(CH_2)_3OCH_2.CHOHCH_2N^+(O)^-(CH_3)C_{10}H_{21}$ $[CH_3CO(OC_2H_4)_6O]_2(CH_3O)SiCH_2OCH_2.CHOHCH_2N^+[(C_2H_4O)_8H]_2CH_3\ Br^-$ $[H(OC_2H_4)_{18}O](C_2H_5O)(C_{10}H_{21})SiCH_2OCH_2.CHOHCH_2N^+[(C_2H_4O)C_3H_7](CH_3)_2\ Cl^-$ $[H(OC_2H_4)_8O](C_2H_5O)_2SiCH_2OCH_2P^+(CH_3)_2C_6H_5\ Cl^-$ $[CH_3(OC_2H_4)_6O](C_{12}H_{25})(CH_3O)SiCH_2OCH_2.CHOHCH_2P^+[(C_2H_4O)_6OCH_3]_2(CH_3)\ Cl^-$ $[CH_3CO(OC_3H_6)_4O]_2(CH_3O)Si(CH_2)_3OCH_2.CHOHCH_2P^+(C_4H_8OH)_2CH_3\ Cl^-$ $[H(OC_4H_8)_2O](CH_3O)(CH_3)SiCH_2OCH_2.CHOHCH_2S^+[(C_2H_4O)_3H]C_2H_5\ Cl^-$ $[C_3H_7(OC_2H_4O](C_4H_9O)_2Si(CH_2)_2OCH_2\text{-}CHOHCH_2S^+(C_3H_6COOH)CH_3\ Br^-$ $[C_2H_5CO(OC_2H_4)_{10}O]_2(C_2H_5O)SiCH_2OCH_2\text{-}CHOHCH_2S^+(O)^-C_{12}H_{25}$ Commonly assigned copending patent application "Organosilane Compounds" by Heckert and Watt, U.S. Ser. No. 570,539 filed Apr. 22, 1975 discloses the preparation of these compounds. (The disclosure of this application is herein incorporated by reference.)

Siloxane oligomers of the above organosilanes are also useful in the present invention. Such oligomers are formed from the monomers by the controlled addition of from 1 to 100 equivalents of water, preferably in an inert solvent such as alcohol, tetrahydrofuran, etc. As used herein, "oligomers" is used to mean a degree of polymerization of from 2 to 100, preferably 2 to 20. A higher degree of polymerization adversely affects the ability of the compound to bond itself to the hard surface and is for this reason avoided. Examples of siloxane oligomers having varying degrees of polymerization are readily visualized from the above examples of organosilane monomers.

The second component of the compositions of the present invention is a water-soluble organic anionic detergent. U.S. Pat. No. 3,579,454 issued May 18, 1971 to Everett J. Collier, Column 11, line 49 to Column 12, line 15 (the disclosure of which is herein incorporated by reference) describes suitable detergents which fall within the above-described class. The ratio of organosilane to anionic detergent is from 1:1 to 1:10,000, preferably 1:1 to 1:500, most preferably 1:3 to 1:60. An amount of organosilane below 1:10000 does not initially provide a noticeable soil release benefit. A benefit is realized from compositions containing a ratio of organosilane to detergent of less than 1:10000 after repeated washings due to a gradual buildup of deposited organosilane, but is, for all practical purposes, too gradual to be of significance. The upper level of organosilane in the composition is dictated by cost and the fact that no noticeable additional soil release benefit is obtained. Generally, the amount of organosilane in a detergent composition does not exceed 10%.

The third component of the compositions of the present invention is a source of alkalinity. This can be either organic or inorganic in nature. Suitable organic bases are mono, di and triethanolamines and isopropanolamines. Suitable inorganic bases are ammonium and alkali metal hydroxides, aluminates, phosphates (such as pyro, ortho and tripolyphosphates) and certain carboxylates such as carbonates and acetates. Ammonium, potassium and sodium hydroxide are particularly preferred. The level of alkali present should be such that a 0.2% solution of the product in water has a pH in the range 8.5–10.5 preferably 8.7–10.0. This generally corresponds to a product pH in the range of 9–12, although the precise measurement of pH values for concentrated detergent solutions is difficult. The solution pH controls the rate at which the organosilane deposits onto the surfaces being treated whilst the product pH determines stability of the organosilane and storage.

Where bases are used that possess buffering capacity e.g. alkanolamines, carbonates and certain phosphates, a lower product pH (i.e. $\ngtr$ pH 9.5) is preferably employed in order to avoid undue harshness to the skin of the user.

In the absence of any buffering capacity, a higher product pH, e.g. pH 10–12 can be used as the level of added alkalinity necessary to achieve these product pH values will be low, normally in the range 0.05 – 5% by weight of the total composition. However, the in-use pH of the product at 0.1%–0.2% concentration in water will only be in the range 8.5–10.0 which is not excessively alkaline to the skin.

The influence of pH on the effectiveness of organosilane deposition from detergent compositions can be seen from the following table in which five samples of the same detergent formulation were adjusted to different pHs and then utilized as 0.2% solutions in 115° F water of 5 U.S. grains/gallon mineral hardness (Ca:Mg = 3:1 expressed as $CaCO_3$) to treat glass microscope slides. After exposure for a specified period in the solution each slide was rinsed and a measurement taken of the contact angle of a water droplet on the slide surface. The higher the angle of contact, the greater the deposition and correspondingly the greater the effect on soil release and water drainage rate from the surface.

The Base formula was (parts by weight):

| | |
|---|---|
| $(C_2H_5O)_3Si(CH_2)_3N^+(CH_3)_2C_8H_{17}\ Cl^-$ | 0.5 |
| Sodium coconut alkyl sulfate | 15.0 |
| Coconut alcohol condensed with an average of 6 moles of ethylene oxide | 15.0 |
| Coconut dimethyl amine oxide | 5.0 |
| Ethyl alcohol | 10.0 |
| Water | to 100.0 |

The results were as follows:

| | | | Contact Angle° After Exposure for Minutes | | |
|---|---|---|---|---|---|
| | | | 2 | 5 | 10 |
| Base | Product pH | 7 | | | |
| | Solution pH | 7.5 | 11 | 14 | 12 |
| Base + 5% | Product pH | 8.8 | | | |
| Triethanolamine | Solution pH | 8.4 | 10 | 12 | 13 |
| Base + NaOH | Product pH | 9.0 | | | |
| | Solution pH | 8.7 | 17 | 29 | 41 |
| Base + 5% | Product pH | 10.1 | | | |
| diethanolamine | Solution pH | 9.4 | 17 | 46 | 72 |
| Base + 5% mono- | Product pH | 10.95 | | | |
| ethanolamine | Solution pH | 10.0 | 50 | 71 | 70 |

Product pH values were measured directly and solution pH values were determined at a concentration of 0.2% in water. It can be seen that little or no enhancement of deposition occurs below a solution pH of 8.5, with a steep rise in deposition over the pH range 8.5–10.0, there being a smaller increase in deposition above pH 10.0.

Although the mechanism by which increased alkalinity improves stability and deposition is not fully understood, it is believed that it is related to the complex pH dependency of the polymerization reaction of organosilicone compounds to form structures of the type

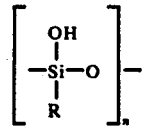

where R is an organic group and $n$ is 2–500 or more.

It is postulated that polymerization decreases over the pH range 8–12 and that at very high pH values (>11.5) polymerization essentially ceases and may even be reversed. It is further postulated that this trend makes available more monomeric or low molecular weight oligomeric material for deposition onto the hard surfaces of utensils, cutlery, ceramics, etc. that are being treated.

The incorporation of alkalinity into organosilane-containing products provides a number of advantages. Aqueous products which develop phase instability (cloudiness) within a short period (e.g., 1 day) at neutral pH (6.5–7.5), are stable for indefinite periods at higher pH values (i.e., pH 10–12).

The effort required to remove baked-on food soil from hard surfaces is lower following their treatment with high pH products of the present invention than it is with similar products of neutral pH. Similarly the rate of drainage of water from hard surfaces is enhanced by treatment with high pH organosilane-containing products relative to the rate of drainage of similar products at neutral pH.

An optional but preferred component of the detergent compositions of the invention is a source of multivalent ions particularly mineral hardness ions, i.e. $Ca^{++}$, $Mg^{++}$, or $Ba^{++}$. The level of incorporation of multivalent cations normally ranges from about 0.5% to about 10% by weight of the composition.

The presence of mineral hardness ion appears to provide the same enhancement of product performance as does increased alkalinity. This is particularly evident with respect to the speed of drainage of water from surfaces that have been cleansed by detergent compositions in accordance with the invention. The improvement is especially noticeable at higher pH values although this leads to a precipitation of the mineral hardness as an insoluble salt. However, such precipitation does not appear to diminish the effectiveness of the combination and is aesthetically acceptable in gels or opaque liquid products.

Any source of mineral hardness can be employed. For example, it can be added by means of a water-soluble salt such as the chloride or nitrate. It may form part or all of the cation of the anionic surfactant, obtained by neutralization of the surfactant acid with alkali earth metal oxide or hydroxide, or it may be introduced together with - $OH^-$ ions by direct addition of $Ca(OH)_2$, $Ba(OH_2)$ or $Mg(OH)_2$ to the formulation. Part of the mineral hardness may be supplied by the salts occurring naturally in the water supply. Where the mineral hardness is added as one or more water-soluble salts, the levels of incorporation normally lie in the range of from about 2% to 15% by weight, preferably 2% to 10% and most preferably 5% to 10% by weight of the composition, these weights being on an anhydrous salt basis.

A further optional but preferred component of the detergent compositions of the present invention is a nonionic surfactant of one of the following classes.

1. water-soluble, nonionic, tertiary amine oxides as represented hereinafter by the general formula $$R_1R_2R_3N \rightarrow O \qquad (I)$$

whereby the arrow is a conventional representation of a semi-polar bond; $R_1$ represents a high molecular, straight or branched, saturated or unsaturated, aliphatic hydrocarbon, hydroxyhydrocarbon, or alkyloxyhydrocarbon radical, preferably an alkyl radical, having in total 8 to 24, preferably 12 to 18, most preferably 12 carbon atoms, or a mixture of dodecyl with decyl and tetradecyl radicals, whereby at least 50% of the radicals are dodecyl; $R_2$ and $R_3$, which may be the same or different, represent each a methyl, ethyl, hydroxymethyl, and hydroxyethyl radical. They are generally prepared by direct oxidation of appropriate tertiary amines, according to known methods. Specific examples of tertiary amine oxides are: dimethyl dodecyl amine oxide, diethyl tetradecyl amine oxide, bis-(2-hydroxyethyl)-dodecyl amine oxide, bis-(2-hydroxyethyl)-3-dodecoxy-1-hydroxypropyl amine oxide, dimethyl 2-hydroxy-dodecyl amine oxide, and diethyl eicosyl amine oxide;

2. water-soluble amides as represented hereinafter by the general formula $$R_4—CO—N(H)_{m-1}(R_5OH)_{2-m}$$

wherein $R_4$ is a saturated or unsaturated, aliphatic hydrocarbon radical having from 7 to 21, preferably from 11 to 17 carbon atoms; $R_5$ represents a methylene or ethylene group; and $m$ is 1 or 2 preferably 1. Specific examples of said amides are mono-ethanol coconut fatty acid amide, diethanol dodecyl fatty acid amide, and dimethanol oleyl amide;

3. water-soluble condensation products obtained by condensing from 3 to about 25 moles of an alkylene oxide, preferably ethylene or propylene oxide, with one mole of an organic, hydrophobic compound, aliphatic or alkyl aromatic in nature, having 8 to 24 carbon atoms and at least one reactive hydrogen atom, preferably a reactive hydroxyl, amino, amido, or carboxy group. General examples are:

a. the condensates of ethylene oxide with aliphatic alcohols of more than eight carbon atoms. The alcohols can be derived from the naturally occurring fatty acids, but also from various branched-chain higher alcohols. Among the preferred alcohol-ethylene oxide condensation products are those made from alcohols derived from tallow and coconut fatty acids. Most preferred are condensation products of about 4 to about 12 moles of ethylene oxide per mole of an aliphatic alcohol having from 10 to about 18 carbon atoms, in particular a middle-cut coconut fatty alcohol condensed with 6 moles of ethylene oxide;

b. condensates of ethylene oxide with alkylphenols, whereby the phenols may be mono- or polyalkylated and the total number of side-chain carbon atoms is as low as 5 to as high as 18 carbon atoms. The aromatic nucleus bearing the phenolic hydroxyl may be benzene, naphthalene, or diphenyl, preferably benzene. Specific examples are condensation products of one mole nonylphenol with 9 to 15 moles of ethylene oxide;

c. condensates of ethylene oxide with the fatty acid esters, preferably mono-fatty acid esters of the sugar alcohols, sorbitol and manitol, and, but less preferred, of di- and polysaccharides. Specific examples are the polyoxyethylene sorbitan-monolauric acid esters, having 20 and more ethylene oxide units; and the polyoxyethylene derivatives of fatty acid partial esters of hexitol anhydrides generally known under the trade name TWEEN; ICI America, Inc., Wilmington, Del.

d. polyethenoxy esters or esters by reacting ethylene oxide with carboxylic acids. The acids can be natural fatty acids or fatty acids made from oxidized paraffin wax, or mono- or polyalkylated benzoic and naphthenic acids. Preferred are aliphatic fatty acids having from 10 to 20 carbon atoms, and benzoic acids with 5 to 18 carbon atoms in the alkyl groups. Specific examples and preferred condensation products are tall oil-ethylene oxide and oleic acid-ethylene oxide condensation products having 9 to 15 ethylene oxide units;

e. condensation products of fatty acyl alkanolamides of the type $C_{7-17}$ alkyl-CO-$NHC_2H_4OH$, $C_{7-17}$ alkyl-CO—N—$(C_2H_4OH)_2$ with ethylene oxide. Preferred are condensation products of one mole coconut-CO—NH—$C_2H_4OH$ with 5 to 20 moles of ethylene oxide. Specific examples of polyethenoxy alkanolamides of fatty acids are the commercial products, marketed under the trade name ETHOMID; Armour Chemicals Co., Chicago, Illinois.

f. condensation products of $C_{8-18}$ alkyl-, $C_{8-18}$ alkenyl-amd $C_{5-18}$ alkylaryl amines and ethylene oxide. A specific and preferred example is the condensation product of one mole of a dodecylamine with 9–12 moles of ethylene oxide. Another specific example has the formula $C_{11-13}$alkyl—CO—NH-$C_6H_4$—N—$[(OC_2H_4)_6OH]_2$.

The levels of nonionic surface-active detergent in the liquid detergent composition of the present invention lie in the range of 3–30% by weight, preferably 5–25% by weight.

When metallic or vitreous surfaces are contacted with a detergent composition containing the above-described organosilanes, a thin coating of the organosilane is attached to the surfaces. It is theorized that the positively charged organosilane is attracted to the negatively charged metallic or vitreous surface and a bond forms between the surface and the silicon atom in the organosilane. The presence of the positive charge on the organosilane is necessary to allow the bonding to take place within a reasonable time when the organosilane is applied from a dilute system such as is normally encountered in detergent composition uses. The terminal alkyl groups attached to the positively charged compound provide the soil release benefits. It is believed that the organosilane compound polymerizes on the surface to form a thin coating of the which is responsible for imparting the soil release benefits to the surface. A hard surface having a polymeric coating thereon will be soiled but the soil is not tenaciously bound to the surface because of the polymeric coating and for this reason the soil is easily washed away.

Repeated washing will subsequently remove the polymeric coating. However, the soil release benefit is renewed by using the detergent compositions of this invention. The ability to provide a soil release benefit from a wash or rinse solution is especially beneficial in that it allows the consumer to efficiently and economically impart the benefit to a hard surface without adversely affecting its appearance.

Organosilane-containing detergent compositions to which the present invention can be applied are described in the following paragraphs.

LIGHT DUTY LIQUID DETERGENT COMPOSITION

Detergent compositions intended for use in the hand washing of cooking utensils and tableware are generally formulated in a liquid form. The composition consists essentially of from 0.01% to 10%, preferably 0.1% to 2% of the organosilane; from 5% to 90%, preferably 10% to 40% and most preferably 15–35% by weight of the composition water. An optional but highly preferred ingredient is a nonionic surfactant serving as a suds modifier to boost or control suds level. Such a surfactant is normally present at a level of 3–30% by weight, preferably 5–25% by weight. An electrolyte such as potassium or sodium chloride is optionally included at a level of from 0.5% to 5%, preferably 1% to 2%. A hydrotrope, e.g. toluene sulfonate, cumene sulfonate, or xylene sulfonate is optionally included in the composition at a level of from 1% to 20%, preferably 2% to 5%. An alcohol, e.g. a $C_{1-4}$ alcohol, may be a part of the composition at a level of from 1% to 20%, preferably 3% to 10%.

WINDOW CLEANER

Window cleaner compositions contain from 0.001% to 5%, preferably 0.002% to 1% of the organosilane. The remainder of the window cleaner composition consists essentially of from 0.1% to 5%, preferably 0.5% to 3% of a water-soluble anionic detergent and the balance organic inert solvent or solvent/water mixture. Suitable organic inert solvents include the following: methanol, ethanol, isopropanol, acetone, and methyl ethyl ketone.

CAR WASH DETERGENT COMPOSITION

A detergent composition intended for use in an automatic car wash consists essentially of from 0.01% to 10%, preferably 0.1% to 2% of the organosilane; from 20% to 35%, preferably 23% to 28% of the anionic detergent; and the balance water. Optionally from 1% to 10%, preferably 1% to 3% of magnesium sulfate is included in the composition.

IN TANK TOILET BOWL CLEANER

In tank toilet bowl cleaners consist essentially of from 0.01% to 10%, preferably 0.5% to 2% of the organosilane; from 0.5% to 20%, preferably 1% to 15% of the anionic detergent; from 0.1% to 5%, preferably 0.5% to 2% of sodium bisulfate; from 0.1% to 20%, preferably 1% to 15% of a lower alcohol, i.e. a $C_{1-4}$ alcohol; and the balance water.

ABRASIVE CLEANER

The organosilane of this invention can also be used in a detergent composition intended for the cleaning of hard surfaces such as ovens. Such compositions contain from 0.002 to 5%, preferably 0.01% to 1% of the organosilane; from 0.1% to 10%, preferably 1% to 5% of a water-soluble anionic detergent; and from 50% to 95%, preferably 50% to 75% of a water-insoluble abrasive. Suitable abrasives include the following: quartz, pumice, pumicate, talc, silica sand, calcium carbonate, china clay, zirconium silicate, bentonite, diatomaceous earth, whiting, feldspar and aluminum oxide.

Other surfactant types, e.g. zwitterionic, and ampholytic surfactants may be included in the above-described compositions at low levels, e.g. not greater than 50% based on the total detergent level. Such minor additions do not materially affect the performance of the present compositions.

The following examples are illustrative of this invention.

EXAMPLE I

The following composition was prepared (parts by weight):

| | |
|---|---|
| Sodium coconut alkyl sulfate | 20.0 |
| Coconut alcohol condensed with six moles of ethylene oxide | 10.0 |
| Coconut dimethyl amine oxide | 5.0 |
| Ethanol | 10.0 |
| Diethanolamine | 5.0 |
| 3-($C_8$ alkyl dimethylammonio)-propane-1-(triethoxy)silane | 0.5 |
| Water | to 100.0 |

This formulation had a pH of 9.5 and, on dilution a 0.2% solution pH of 8.7–8.8.

The formulation was tested for its ability to impart soil release characteristics to glass surfaces using the following test method.

A simulated food soil (identified hereinafter as HEFT) was prepared by making a puree of 90 grams ground beef in 150 ml of water at 70° F by mixing in a domestic food blender for 60 seconds. An egg was added to the puree and blended for 30 seconds, after which 8 oz. of Hunt's Tomato sauce was added and blended for a similar length of time and finally 30 grams of flour were added and given 30 seconds of mixing.

A sheet of Pyrex brand glass was cut into 2 inches × 4 inches pieces of ⅛ inch thickness and each piece was soiled with HEFT, baked for 20 minutes at 400° F, cooled, washed in a 0.20% solution of a commercial dishwashing liquid detergent, (JOY manufactured by The Procter & Gamble Company, Cincinnati, Ohio USA), rinsed and air dried.

Pieces of the Pyrex and glass microscope slides were then pretreated by immersion in a 0.20% aqueous solution of the formulations for various periods after which they were rinsed for ≈2 seconds and then air dried. The microscope slides were then used to measure contact angle while the dried pieces were soiled again with HEFT applied by means of a brush and baked in a preheated oven at 400° F for 20 minutes before being allowed to cool for approximately 15 minutes.

Washing of the soiled pieces to evaluate the efficacy of the soil release treatment took place in a 0.20% solution of JOY dishwashing liquid, made up in 115° F water of 5 grains mineral hardness/U.S. gallon (Ca:Mg = 3.1).

The pieces were immersed in the washing solution and a dishcloth folded in half four times was used to clean them, by making successive strokes across the entire surface of each piece. The number of strokes to clean each side of the piece was counted. For each data point, three replicates were run and the average was taken of the results, expressed as a % Reduction in Effort. The figure is arrived at by subtracting the number of strokes for the sample from that for an untreated control and expressing the difference so obtained as a percentage of the number of strokes for the untreated control.

Using this technique the following results were obtained:

| Pretreatment | | % Reduction in Cleaning Effort | Contact Angle |
|---|---|---|---|
| Mineral Hardness | Length of Soak, Min. | | |
| 0 gr | 10 min. | 52 | 39 |
| 10 gr | 10 min. | 80 | 63 |

Contact angle can be correlated approximately with the drainage of water from a vitreous surface as follows:

<30° — slow continuous film drainage

30°–50° — faster drainage with some film collapse

>50° — complete film collapse, very rapid drainage

It can be seen that the use of a high solution pH provides a significant reduction in cleaning effort and a further reduction is achieved by the addition of mineral hardness. A marked increase in the drainage rate from the surface (as measured by increase in contact angle) can also be seen for the addition of mineral hardness.

EXAMPLE II

The following formulation was prepared (parts by weight):

| | |
|---|---|
| Sodium coconut alkyl ether sulfate containing three moles of ethylene oxide | 22.8 |
| Sodium coconut alkyl sulfate | 4.5 |
| Coconut dimethyl amine oxide | 5.0 |
| Ethanol | 9.0 |
| 3-($C_{12}$ alkyl dimethylammonio)-propane-1-(triethoxy)silane | 0.5 |
| Water | to 100.0 |

This product was adjusted to pH 11.7 with NaOH and then used as a pretreatment solution, the pH of which at 0.2% concentration was 9.0. The procedure in Example I was followed and the results are shown below:

| Pretreatment | | % Reduction in Cleaning Effort | Contact Angle |
|---|---|---|---|
| Mineral Hardness | Length of Soak, Min. | | |
| 0 gr | 1 min. | 39 | 6 |
| 10 gr | 1 min. | 82 | 39 |
| 0 gr | 10 min. | 80 | 15 |
| 10 gr | 10 min. | 81 | 75 |

In this experiment the benefit of added hardness and the longer pretreatment time can clearly be seen for both cleaning and drainage effects.

EXAMPLE III

For comparative purposes, the procedure of Example I was repeated using the following formulation for pretreatment purposes (parts by weight):

| | |
|---|---|
| Ammonium coconut alkyl ether sulfate (containing three ethylene oxide groups) | 25.0 |
| Sodium coconut alkyl glyceryl ether sulfonate | 4.0 |
| Coconut dimethyl amine oxide | 5.0 |
| Ethanol | 9.0 |
| 3-($C_8$ alkyl dimethylammonio)-propane-1-(triethoxy)silane | 0.5 |
| Water | to 100.0 |
| pH adjusted to 7.0 | |

A 0.2% solution of the product also had a pH of 7.0.

| Pretreatment Mineral Hardness | Pretreatment Length of Soak, Min. | % Reduction in Effort | Contact Angle |
|---|---|---|---|
| 0 gr | 10 min. | 39 | 21 |
| 10 gr | 10 min. | 44 | 17 |

It can be seen that although some reduction in cleaning effort was noted, the contact angles (reflecting the rate of drainage) were low. In addition, it can be noted that mineral hardness fails to give any benefit in a neutral pH system.

EXAMPLE IV

The following composition was prepared (parts by weight):

| | |
|---|---|
| Sodium coconut alkyl sulfate | 25.0 |
| Coconut dimethyl amine oxide | 5.0 |
| Ethanol | 10.0 |
| 3-($C_8$ alkyl dimethylammonio)-propane-1-(triethoxy)silane | 1.0 |
| Water | to 100.0 |

The formulation was split into two portions, one of which was adjusted to pH 12 and the other of which was adjusted to pH 8, using NaOH or HCl as the source of basicity/acidity.

Each formulation was then tested for its ability to impart soil release characteristics to glass surfaces, using a modification of the test method of Example I in that only one replicate was used. Using this technique the following results were obtained:

| Pretreatment Mineral Hardness | Pretreatment Length of Soak, Min. | Washing No. of Strokes until Clean ph 12 | Washing No. of Strokes until Clean pH 8 | Reduction in Effort |
|---|---|---|---|---|
| 0 gr | 1 min. | 8 | 15 | 46.6% |
| 10 gr | 1 min. | 7 | 16 | 56.3% |
| 0 gr | 10 min. | 4 | 23 | 82.6% |
| 10 gr | 10 min. | 3 | 4 | 25.0% |

In this instance the % Reduction in Effort was calculated by reference to the difference between the two treatments, i.e. the pH 8 treatment was used as a control.

It can be seen that in each instance the higher pH pretreatment resulted in a significant reduction in cleaning effort.

Contact Angles were measured on microscope slides exposed to the same pretreatment as the Pyrex pieces and were as follows for each of the above pretreatment conditions.

| Pretreatment Mineral Hardness | Pretreatment Length of Soak, Min. | Contact Angle° pH 12 | Contact Angle° pH 8 |
|---|---|---|---|
| 0 gr | 1 min. | 23 | 19 |
| 10 gr | 1 min. | 34 | 50 |
| 0 gr | 10 min. | 67 | 20 |
| 10 gr | 10 min. | 66 | 60 |

The beneficial effect on film drainage rate of higher pH pretreatment can be seen, particularly for the longer treatment time.

EXAMPLE V

A light-duty liquid detergent formulation was made up as follows (parts by weight):

| | |
|---|---|
| Sodium coconut alkyl ether sulfate containing an average of 3 ethylene oxide groups | 22.8 |
| Sodium coconut alkyl sulfate | 4.5 |
| Coconut alkyl dimethyl amine oxide | 5.0 |
| Ethanol | 9.0 |
| 3-($C_{12}$ alkyl dimethyl ammonio)-propane-1-(triethoxy)silane | 1.0 |
| Water | to 100.0 |

The formulation as made was a single phase, clear, pale straw-colored liquid. It was split into two portions, one of which was adjusted to pH 7.0, and the other of which was adjusted to pH 11.7 with NaOH. The portion that had pH 7.0 demonstrated instability (i.e. cloudiness) within one day whereas the solution at pH 11.7 remained stable for an indefinite period.

The experiment was repeated and identical results were obtained using the $C_{10}$ alkyl homologue of the organosilane.

Identical results are also obtained when the above organosilanes are replaced by any of the following:

$(C_2H_5O)_3SiCH_2CH_2CH_2N^+(CH_3)_2C_{18}H_{37}$ $Cl^-$ $(CH_3O)_3SiCH_2CH_2CH_2N^+(CH_3)_2C_{16}H_{33}$ $Cl^-$ $(C_2H_5O)_3SiCH_2N^+(O)^-(CH_3)C_{12}H_{25}$ $(C_2H_5O)_3SiCH_2S^+(O)^-C_{12}H_{25}$ $(CH_3O)_3Si(CH_2)_3N^+(CH_3)_2C_6H_4C_3H_7$ $Cl^-$ $(CH_3O)_3SiCH_2N^+(C_2H_4OH)(CH_3)C_{12}H_{25}$ $Cl^-$ $(CH_3O)_3Si(CH_2)_3OCH_2CHOHCH_2N^+(CH_3)_2C_8H_{17}$ $Cl^-$ $(C_2H_5O)_2C_4H_9SiCH_2N^+(CH_3)_2C_{12}H_{25}$ $Cl^-$ $[H(OC_2H_4)_{18}O]]_3SiCH_2N^+(C_2H_5)_2C_{10}H_{21}$ $Cl^-$ $[CH_3(OC_2H_4)_{12}O]_2CH_3SiCH_2N^+(CH_3)_2C_{12}H_{25}$ $Br^-$ $[CH_3CO(OC_2H_4)_4]_3Si(CH_2)_3N^+(CH_3)_2C_{10}H_{21}$ $Cl^-$ $[H(OC_2H_4)_8](CH_3O)_2SiCH_2N^+(CH_3)_2C_{12}H_{25}$ $Cl^-$ $[CH_3(OC_2H_4)_6O]_3SiCH(C_{12}H_{25})N^+(CH_3)_3$ $Br^-$ $[H(OC_2H_4)_2O]_2(CH_3O)SiCH(C_8H_{17})N^+(CH_3)_2C_6H_{13}$ $Cl^-$ $[H(OC_2H_4)_4O]_3SiCH_2OCH_2CHOHCH_2N^+(CH_3)_2C_{12}H_{25}$ $Cl^-$ $[CH_3(OC_2H_4)_8O]_2(CH_3O)SiCH_2OCH_2CHOHCH_2N^+(C_4H_9)_3$ $Cl^-$

Siloxane dimer of $(C_2H_5O)_3SiCH_2N^+(CH_3)_2C_{12}H_{25}$ $Cl^-$

Siloxane dimer of $(C_2H_5O)_2(CH_3)SiCH_2N^+(CH_3)_2C_8H_{17}$ $Cl^-$

Siloxane trimer of $(CH_3O)_3Si(CH_2)_3P^+(CH_3)_2C_{12}H_{25}$ $Cl^-$

Siloxane dimer of $(CH_3O)_3SiCH_2S^+(CH_3)C_{12}H_{25}$ $Cl^-$

What is claimed is:

1. A detergent composition capable of imparting soil release benefits to metallic and vitreous surfaces contacted therewith consisting essentially of:

a. an organosilane having the formula

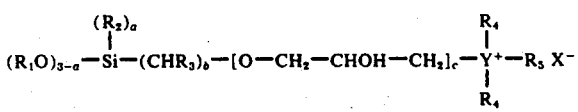

or a siloxane oligomer thereof wherein $R_1$ is an alkyl group containing 1 to 4 carbon atoms or $$Z(OC_xH_{2x})_m$$

where $x$ is 2 to 4, $m$ is 1 to 20, and Z is hydrogen, an alkyl group containing 1 to 3 carbons, or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that there is no $X^-$ when $R_4$ is oxygen; $R_5$ is an alkyl, aryl or arylalkyl group containing 1 to 18 carbon atoms; X is bromide or chloride; and Y is nitrogen, sulfur, or phosphorus and the sum of the carbon atoms in $R_2$, $R_3$, $R_5$ and $R_4$ when $R_4$ is alkyl, aryl, arylalkyl or carboxy-substituted alkyl does not exceed 30 carbon atoms;

b. a water-soluble organic anionic detergent in a weight ratio of organosilane to detergent of from 1:1 to 1:10,000; and c. a source of alkalinity in an amount such that the pH of a 0.2% aqueous solution of the composition lies in the range 8.5–10.5, said source being selected from the group consisting of water-soluble inorganic and organic bases.

2. The composition of claim 1 wherein the organosilane has the formula $$[Z(OC_xH_{2x})_mO]_{3-a}-\overset{(R_2)_a}{\overset{|}{Si}}-(CH_2)_b-\overset{R_4}{\overset{|}{\underset{\underset{R_4}{|}}{Y^+}}}-R_5\ X^-$$

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $b$ is 1 to 3; $R_4$ is an alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 30.

3. The composition of claim 1 wherein the organosilane has the formula $$[Z(OC_xH_{2x})_mO]_{3-(a+d)}-\underset{\underset{(OR_1)_d}{|}}{\overset{(R_2)_a}{\overset{|}{Si}}}-(CH_2)_b-\overset{R_4}{\overset{|}{\underset{\underset{R_4}{|}}{Y^+}}}-R_5\ X^-$$

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided $a+d$ does not exceed 2; $b$ is 1 to 3; $R_4$ is an alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 30.

4. The composition of claim 1 wherein the organosilane has the formula $$[Z(OC_xH_{2x})_mO]_{3-a}-\overset{(R_2)_a}{\overset{|}{Si}}-CHR_3-\overset{R_4}{\overset{|}{\underset{\underset{R_4}{|}}{Y^+}}}-R_5\ X^-$$

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $R_3$ is an alkyl group containing 1 to 18 carbon atoms; $R_4$ is an alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 30.

5. The composition of claim 1 wherein the organosilane has the formula $$[Z(OC_xH_{2x})_mO]_{3-(a+d)}-\underset{\underset{(OR_1)_d}{|}}{\overset{(R_2)_a}{\overset{|}{Si}}}-CHR_3-\overset{R_4}{\overset{|}{\underset{\underset{R_4}{|}}{Y^+}}}-R_5\ X^-$$

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided $a+d$ does not exceed 2; $R_3$ is an alkyl group containing 1 to 18 carbon atoms; $R_4$ is an alkyl, aryl to arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 30.

6. The composition of claim 1 wherein the organosilane has the formula

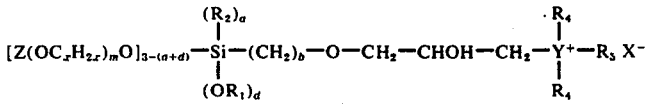

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided $a+d$ does not exceed 2; $b$ is 1 to 3; $R_4$ is an alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided than when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 30.

7. The composition of claim 1 wherein the organosilane has the formula

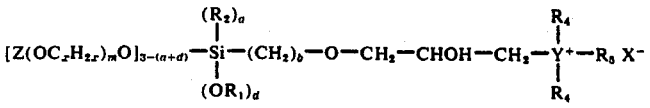

or is a siloxane oligomer thereof wherein Z is hydrogen, an alkyl group containing 1 to 3 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided $a+d$ does not exceed 2; $b$ is 1 to 3; $R_4$ is an alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided than when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 30.

8. The composition of claim 1 in which said organosilane has the formula

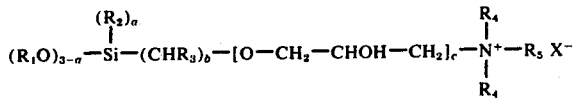

or a siloxane oligomer thereof wherein $R_1$ is an alkyl group containing 1 to 4 carbon atoms or $$Z(OC_xH_{2x})_m$$

where $x$ is 2 to 4, $m$ is 1 to 20, and Z is hydrogen, an alkyl group containing 1 to 3 carbons, or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 18 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that there is no $X^-$ when $R_4$ is oxygen; $R_5$ is an alkyl, aryl or arylalkyl group containing 1 to 18 carbon atoms; X is bromide or chloride and the sum of the carbon atoms in $R_2$, $R_3$, $R_5$ and $R_4$ when $R_4$ is alkyl, aryl, arylalkyl or carboxy-substituted alkyl does not exceed 30 carbon atoms.

9. The composition of claim 1 wherein the source of alkalinity comprises 0.1% to 20% by weight of an organic base selected from the group consisting of mono-, di- and triethanolamines and isopropanolamines.

10. The composition of claim 1 wherein the source of alkalinity is an inorganic base selected from the group consisting of ammonium, sodium and potassium hydroxides, ortho- pyro- and tripolyphosphates, aluminates and carbonates.

11. The composition of claim 1 wherein the source of alkalinity comprises 0.05% to 5% by weight of sodium, potassium or ammonium hydroxide.

12. The composition of claim 1 wherein the organosilane has the formula

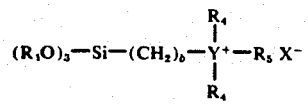

or is a siloxane oligomer thereof wherein $R_1$ is an alkyl group containing 1 to 4 carbon atoms; *b* is 1 to 3; $R_4$ is an alkyl, aryl or arylalkyl group containing 1 to 18 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 3 carbon atoms, an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 4 to 18 carbon atoms; X is bromide or chloride; and Y is nitrogen, sulfur or phosphorus and the sum of the carbon atoms in $R_5$ and $R_4$, when $R_4$ is alkyl, aryl, arylalkyl or carboxy-substituted alkyl does not exceed 30.

13. The composition of claim 1 wherein the organosilane has the formula

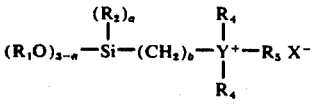

or is a siloxane oligomer thereof wherein $R_1$ is an alkyl group containing 1 to 4 carbon atoms; $R_2$ is an alkyl group containing 1 to 18 carbon atoms; *a* is 1 or 2; *b* is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 3 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atom and in $R_2$, $R_5$ and $R_4$ when $R_4$ is alkyl, aryl, arylalkyl or carboxy-substituted alkyl does not exceed 30.

14. The composition of claim 1 wherein the organosilane has the formula

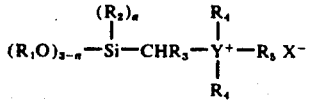

or is a siloxane oligomer thereof wherein $R_1$ is an alkyl group containing 1 to 4 carbon atoms; $R_2$ is an alkyl group containing 1 to 18 carbon atoms; *a* is 0 to 2; $R_3$ is an alkyl group containing 1 to 18 carbon atoms; $R_4$ is an alkyl, aryl or arylalkyl group containing 1 to 18 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 3 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_3$, $R_5$ and $R_4$ when $R_4$ is alkyl, aryl, arylalkyl or carboxy-substituted alkyl does not exceed 30.

15. The composition of claim 1 wherein the organosilane has the formula

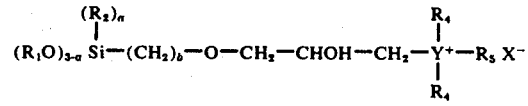

or is a siloxane oligomer thereof wherein $R_1$ is an alkyl group containing 1 to 4 carbon atoms; $R_2$ is an alkyl group containing 1 to 18 carbon atoms; *a* is 0 to 2; *b* is 1 to 3; $R_4$ is an alkyl, aryl or arylalkyl group containing 1 to 18 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 3 carbon atoms or an acyl group containing 1 to 4 carbon atoms, or oxygen provided only one $R_4$ is oxygen and further provided than when $R_4$ is oxygen there is no $X^-$; $R_5$ is an alkyl, aryl or arylalkyl group containing 1 to 18 carbon atoms; X is bromide or chloride; and Y is nitrogen, sulfur or phosphorus and the sum of the carbon atoms in $R_2$, $R_5$ and $R_4$ when $R_4$ is alkyl, aryl, arylalkyl or carboxy-substituted alkyl does not exceed 30.

16. The composition of claim 1 wherein b is 1 and the sum of the carbon atoms in $R_2$, $R_3$, $R_5$ and $R_4$ when $R_4$ is alkyl, aryl, arylalkyl or carboxy-substituted alkyl does not exceed 25.

17. The composition of claim 1 further incorporating a source of calcium, magnesium, or barium ions in an amount of from about 0.5% to about 10% by weight of the composition.

18. The composition of claim 1 intended for use as a light-duty dishwashing composition consisting essentially of:

a. from 0.01% to 10% of the organosilane;
b. from 5% to 90% of the water-soluble organic anionic detergent;
c. from 0.1% to 20% of an organic base selected from the group consisting of mono-, di-, and triethanolamines and isopropanolamines; and
d. the balance water.

19. A light-duty dishwashing composition according to claim 1 consisting essentially of:

a. 0.1% to 2% of the organosilane;
b. from 15% to 35% of the water-soluble anionic surfactant;

c. from 3% to 25% of a nonionic surfactant selected from the group consisting of
i. amine oxides of the formula $$R_1R_2R_3N \rightarrow O$$

wherein $R_1$ is a straight or branched, saturated or unsaturated, aliphatic hydrocarbon, hydroxyhydrocarbon, or alkyloxyhydrocarbon radical containing in total from 8 to 24 carbon atoms; and $R_2$ and $R_3$ are each a methyl, ethyl, hydroxymethyl, or hydroxyethyl radical;
ii. amides of the formula $$R_4\text{-}CO\text{-}N(H)_{m-1}(R_5OH)_{2-m}$$

wherein $R_4$ is a saturated or unsaturated, aliphatic hydrocarbon radical containing from 7 to 21 carbon atoms; $R_5$ represents a methylene or ethylene group; and *m* is 1, 1 or 2;
iii. a condensation product of from about 3 to about 25 moles of alkylene oxide and one mole of an organic, hydrophobic compound, aliphatic or alkyl aromatic in nature selected from the group consisting of aliphatic alcohols, alkyl phenols, fatty acid esters, aliphatic fatty acids, fatty acyl alkanolamides, and alkyl, alkenyl and alkylaryl amines, the latter containing about 8 to about 24 carbon atoms; and mixtures thereof;
d. from 2% to 10% by weight of an alkanolamine selected from the group consisting of mono-, di- and triethanolamines and isopropanolamines;
e. from 2% to 10% by weight of mineral hardness ion present as a calcium, magnesium or barium chloride, nitrate, or hydroxide;
f. from 1% to 20% of a lower alcohol containing from one to four carbon atoms; and
g. the balance water.

20. The composition of claim 1 wherein the source of alkalinity is selected from the group consisting of mono-, di- and triethanolamine and isopropanolamines and ammonium, sodium, and potassium hydroxides, aluminates, phosphates, carbonates, and acetates.

21. The composition of claim 1 wherein the water-soluble, organic anionic detergent is a water-soluble salt or an organic sulfuric acid reaction product having in its molecular structure an alkyl radical containing from about 8 to about 22 carbon atoms and a radical selected from the group consisting of sulfonic acid and sulfuric acid ester radicals.

22. The composition of claim 9 wherein the organic base is present in an amount of from 2% to 10% by weight of the composition.

23. The composition of claim 11 wherein sodium or potassium hydroxide is present in an amount of from 0.1% to 2% by weight.

24. The composition of claim 16 wherein the ratio of organosilane to detergent is from 1:1 to 1:500.

25. The composition of claim 17 wherein the multivalent cations are selected from the group consisting of calcium and magnesium ions.

26. The composition of claim 17 wherein the source of multivalent cations is an calcium, magnesium or barium hydroxide.

27. The composition of claim 25 wherein the calcium or magnesium ions are incorporated in the form of water-soluble salts selected from the group consisting of calcium and magnesium chlorides and nitrates in an amount of from about 2% to about 10% by weight of the anhydrous salts.

28. The composition of claim 18 consisting essentially of:
a. from 0.1% to 2% of the organosilane;
b. from 10% to 40% of the water-soluble organic anionic detergent;
c. from 2% to 10% of the alkanolamine; and
d. the balance water.

29. The composition of claim 20 wherein the water-soluble, organic anionic detergent is selected from the group consisting of sodium, potassium, ammonium and mono-, di-, and triethanolammonium salts of higher fatty acids containing from 10 to 22 carbon atoms; sulfates of alcohols containing from 8 to 18 carbon atoms; alkyl benzene sulfonates in which the alkyl group contains from about 9 to about 15 carbon atoms; alkyl glyceryl ether sulfonates of alcohols derived from tallow or coconut oil, coconut oil, fatty acid, monoglycerides, sulfates, and sulfonates, sulfuric acid esters of the reaction product of one mole of a tallow or coconut oil fatty alcohol and about 1 to 6 moles of ethylene oxide; alkyl phenol ethylene oxide ether sulfates containing 1 to 10 units of ethylene oxide per molecule and 8 to 12 carbon atoms in the alkyl radical; fatty acid estearified isethionic acid, coconut fatty acid amides of methyl tauride and sulfonated alkyl olefins containing from 10 to 24 carbon atoms.

30. The composition of claim 19 additionally containing from 0.5% to 5% of sodium or potassium chloride.

31. The composition of claim 28 additionally containing from 0% to 20% of a hydrotrope selected from the group consisting of toluene, xylene, and cumene sulfonates and from 1% to 20% of a lower alcohol containing from one to four carbon atoms.

* * * * *